US006979212B1

(12) United States Patent
Gorman

(10) Patent No.: US 6,979,212 B1
(45) Date of Patent: Dec. 27, 2005

(54) SAFETY ELECTRICAL PLUG

(75) Inventor: Michael P. Gorman, Laguna Nigel, CA (US)

(73) Assignee: Protect Connect, Irvine, CA (US)

( * ) Notice: Subject to any disclaimer, the term of this patent is extended or adjusted under 35 U.S.C. 154(b) by 0 days.

(21) Appl. No.: 10/988,331

(22) Filed: Nov. 13, 2004

Related U.S. Application Data

(60) Division of application No. 10/265,857, filed on Oct. 7, 2002, now Pat. No. 6,817,873, which is a continuation of application No. 09/761,290, filed on Jan. 16, 2001, now Pat. No. 6,494,728.

(60) Provisional application No. 60/176,123, filed on Jan. 14, 2000.

(51) Int. Cl.[7] ..... H01R 13/44
(52) U.S. Cl. ..... 439/140; 439/911; 174/66
(58) Field of Search ..... 439/139–142, 439/353, 911, 299

(56) References Cited

U.S. PATENT DOCUMENTS

| | | | | |
|---|---|---|---|---|
| 723,866 | A | 3/1903 | Hart | |
| 776,855 | A * | 12/1904 | La Har | 439/138 |
| 949,123 | A | 2/1910 | Klein | |
| 1,171,914 | A | 2/1916 | Wright | |
| 1,328,224 | A | 1/1920 | Benjamin | |
| 2,163,201 | A * | 6/1939 | Kalencik | 439/172 |
| 2,189,251 | A * | 2/1940 | Potter | 439/140 |
| 2,447,597 | A | 8/1948 | Reed | |
| 2,477,803 | A | 8/1949 | Huber | |
| 2,524,701 | A | 10/1950 | Grill | |
| 3,214,726 | A | 10/1965 | Cardenas et al. | |
| 3,317,881 | A | 5/1967 | Setecka | |
| 3,588,786 | A | 6/1971 | Alfiero | |
| 3,930,704 | A | 1/1976 | Dekanic | |
| 4,148,536 | A | 4/1979 | Petropoulsos et al. | |
| 4,179,175 | A | 12/1979 | Farnworth et al. | |
| 4,230,386 | A | 10/1980 | Farnworth et al. | |
| 4,343,411 | A | 8/1982 | Chesnut et al. | |
| 4,445,739 | A | 5/1984 | Wooten | |
| 4,493,517 | A | 1/1985 | Hillary | |
| 4,600,258 | A | 7/1986 | Hu | |
| 4,605,270 | A | 8/1986 | Aslizadeh | |
| 4,617,613 | A | 10/1986 | Rice | |
| 4,626,052 | A * | 12/1986 | Rumble | 439/173 |
| 4,640,564 | A | 2/1987 | Hill | |
| 4,664,457 | A | 5/1987 | Suchy | |
| 4,722,693 | A | 2/1988 | Rose | |
| 4,798,916 | A | 1/1989 | Engel | |
| 4,808,127 | A * | 2/1989 | Swanic | 439/139 |
| 5,030,119 | A * | 7/1991 | Lowe | 439/141 |
| 5,297,973 | A | 3/1994 | Gorman | |
| 5,551,884 | A | 9/1996 | Burkhart, Sr. | |
| 5,611,701 | A * | 3/1997 | Hahn | 439/131 |
| 5,980,279 | A | 11/1999 | Muller | |
| 6,231,358 | B1 | 5/2001 | Kerr, Jr. | |

OTHER PUBLICATIONS

Cooper Industries, Inc.; Crouse-Hinds Division; Power-Lock Locking Devices—Product Specification 1996; pp. B6. B55; Syracuse, NY.

* cited by examiner

*Primary Examiner*—Hae Moon Hyeon
(74) *Attorney, Agent, or Firm*—Law Office of Glenn R. Smith; Glenn R. Smith; Lei Liu

(57) ABSTRACT

An electrical plug comprises a plug housing having a housing face and a generally hollow probe extending from the housing face to a probe face. Prongs are disposed within the probe. The prongs are urged to an unlocked position retracted into the probe and movable to a locked position extending from the probe face.

6 Claims, 42 Drawing Sheets

SECTION A-A

SECTION B-B

SAFETY ELECTRICAL PLUG

CROSS-REFERENCE TO RELATED APPLICATIONS

This application is a divisional of U.S. patent application Ser. No. 10/265,857 filed Oct. 7, 2002, now U.S. Pat. No. 6,817,873 entitled Safety Electrical Connection System, which is a continuation of U.S. patent application Ser. No. 09/761,290 filed Jan. 16, 2001, now U.S. Pat. No. 6,494,728 entitled Safety Electrical Connection System, which relates to and claims the benefit of prior U.S. Provisional Patent Application No. 60/176,123 entitled Safety-Lock Outlet Assembly, filed Jan. 14, 2000, all of the aforementioned prior applications incorporated by reference herein.

BACKGROUND OF THE INVENTION

A standard electrical outlet has open slots that expose children to potentially lethal electrical shock hazards. A curious child is prone to insert a conductive object into one of the slots. A child can be shocked if they are in simultaneous contact with a "hot" conductor and a low impedance path to ground. To avoid this risk, parents of young children frequently insert nonconductive plugs into all unused outlets to block out other objects. These plugs, however, significantly reduce outlet convenience. Standard AC plugs also create a shock hazard due to their tendency to pull partially out of an outlet, leaving exposed prongs that remain connected to electrical power. A child can easily touch these with their small fingers or a conductive object. Further, in research, industrial or military environments, an explosion hazard exists when electrical outlets are used in the vicinity of volatile chemicals and gases, which can be ignited with an inadvertent spark at an exposed contact.

SUMMARY OF THE INVENTION

A safety electrical connection system provides a covered outlet and a corresponding locking plug. Spring-loaded covers block small children from probing the outlet with fingers and foreign objects, yet allow adults to insert a corresponding locking plug without cover removal. Internally, outlet receptacles have no exposed contacts, further reducing the potential for electrical shock. The covered outlet is compatible with existing electrical boxes. A corresponding face plate provides aesthetic wall trim for the outlet and functions to environmentally seal the conductors within. The locking plug is configured to compress the covers when inserted into the outlet. The plug has retracting contacts that extend within the outlet to make a fully-enclosed electrical connection and to lock the plug in place. The plug can be pre-wired as a locking plug or configured as an adapter plug that converts a conventional AC plug to a locking plug.

One aspect of an electrical plug comprises a plug housing having a housing face and a generally hollow probe extending from the housing face to a probe face. Prongs are disposed within the probe. The prongs are urged to an unlocked position retracted into the probe and movable to a locked position extending from the probe face.

Another aspect of an electrical plug comprises a plug housing and a probe portion of the housing adapted to insert into an electrical outlet. Prongs are retained by the probe portion. The prongs are moveable between a first position retracted within the probe portion and a second position extending from the probe portion. The prongs are adapted to connect to an electrical power source in the second position. Conductors within the plug housing are adapted to carry current between the prongs and an electrical load.

A further aspect of an electrical plug comprises a housing and a probe extending from the housing. A pair of prongs is disposed within the probe. Curved spring bar portions of the prongs are configured to urge the prongs to retract within the probe.

BRIEF DESCRIPTION OF THE DRAWINGS

FIG. 1A is a perspective view of a covered outlet and a corresponding locking plug;

FIG. 1B is a perspective view of a locking plug inserted into a covered outlet;

FIG. 1C is a perspective view of two locking plugs inserted into a covered outlet;

FIG. 1D is a front view of a locking plug inserted into a covered outlet;

FIG. 1E is a sectional side view of a locking plug inserted into a covered outlet;

FIG. 1F is a sectional top view of a locking plug inserted into a covered outlet;

FIGS. 2A–B are front and back perspective views, respectively, of a covered outlet;

FIGS. 2C–D are front and back perspective views, respectively, of a covered outlet with the face plate and rear shell removed;

FIG. 2E is a back view of a covered outlet with the rear shell removed;

FIGS. 3–10 illustrate detailed features of covered outlet components;

FIGS. 11A–B are front and back perspective views, respectively, of a locking plug in a locked position;

FIGS. 11C–D are front and back perspective views, respectively, of a locking plug in an unlocked position FIG. 11E is a front perspective view of a locking plug with the door removed, showing an installed standard AC plug;

FIG. 11F is a back perspective view of a locking plug with the door removed, showing a standard AC socket without an installed AC plug;

FIGS. 12–22 illustrate detailed features of locking plug components;

FIG. 12 is an exploded, back perspective view of a locking plug assembly;

DETAILED DESCRIPTION OF THE PREFERRED EMBODIMENTS

Covered Outlet And Locking Plug

Figure 1A:
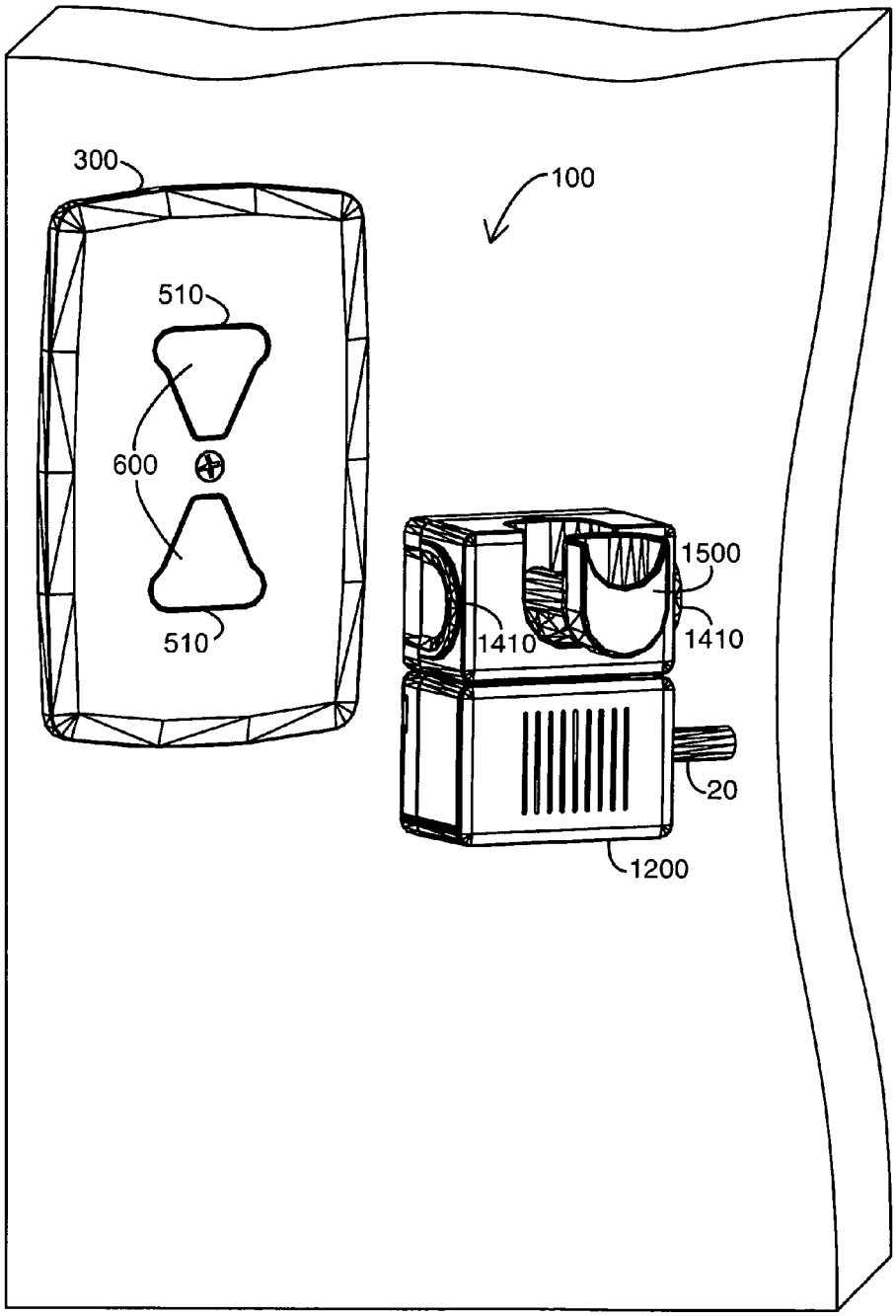
FIGS. 1A–F illustrate top-level features of a safety electrical connection system.
Figure 1B:
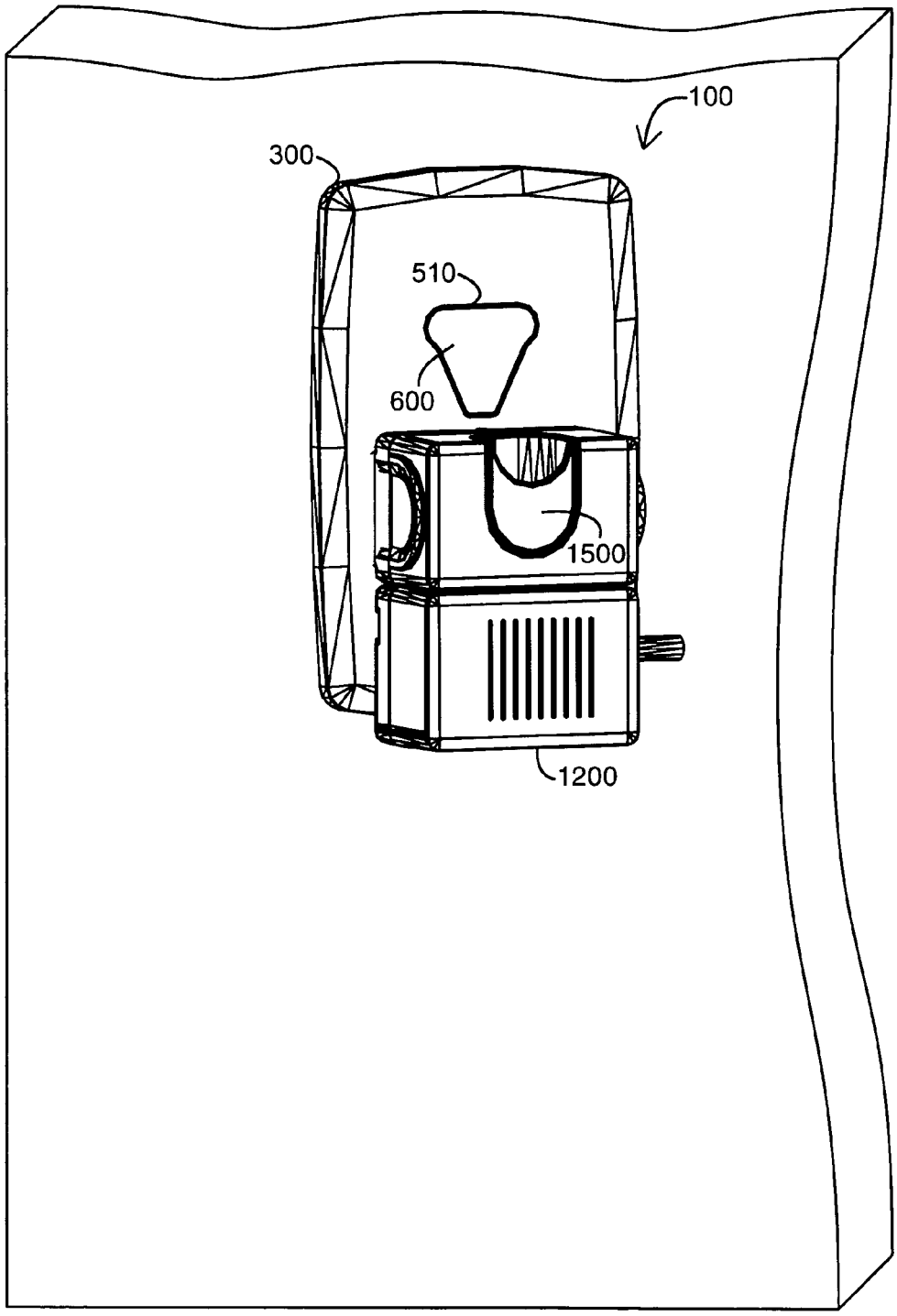
Figure 1C:
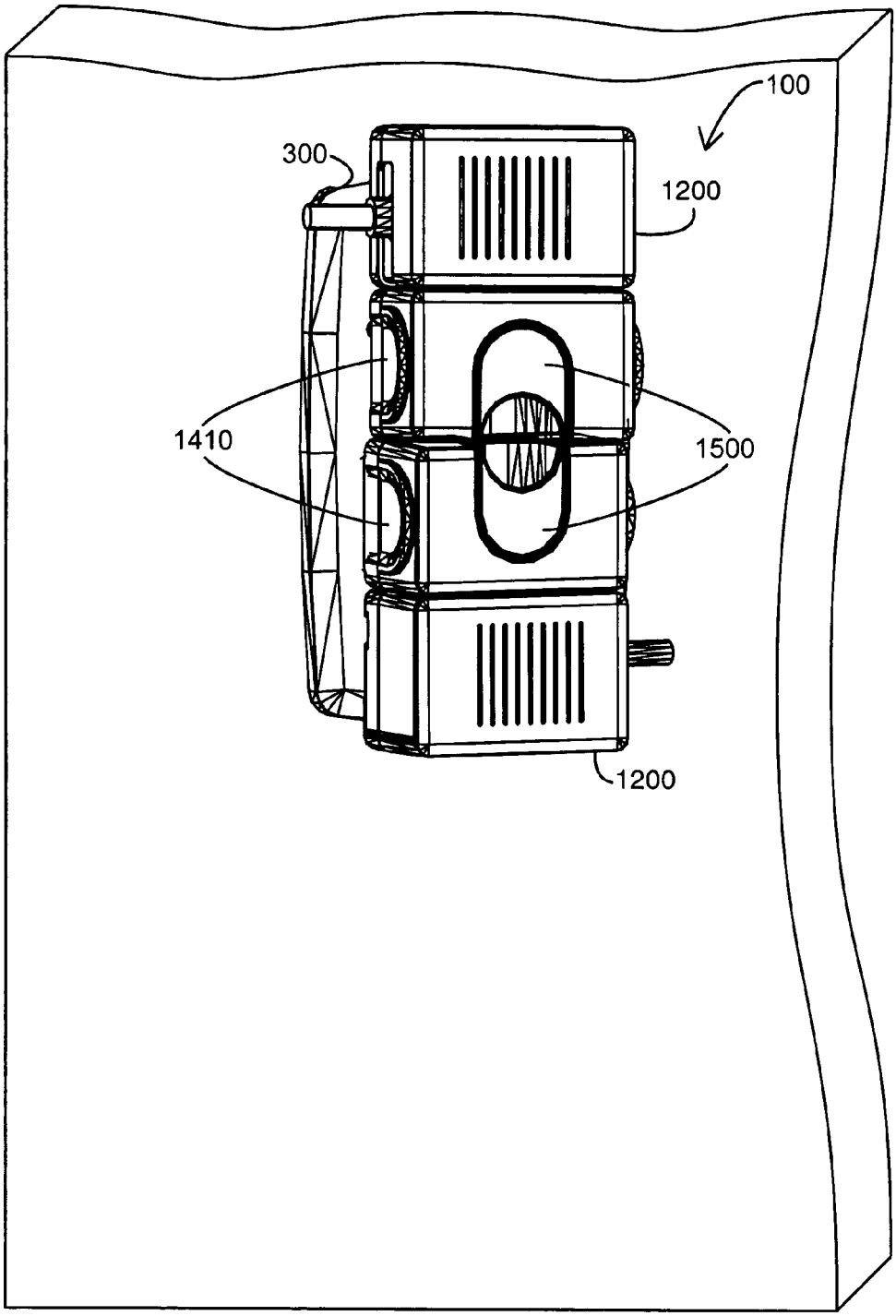

FIGS. 1A–C illustrate top-level, external features of a safety electrical connection system. As shown in FIG. 1A, the electrical connection system 100 has a covered outlet 300 and a corresponding locking plug 1200. The outlet 300 is configured to install at a conventional wall location in order to provide a convenient source of electrical power. Power is supplied to conventional electrical loads, such as lighting, appliances and equipment, through the locking plug 1200 and an associated power cord 20 when the plug 1200 is inserted into the outlet 300. The outlet 300 features covered receptacles 510 that are fitted with spring-loaded covers 600 in order to block access by small children. Electrical contacts are recessed within the covered receptacles 510 to prevent inadvertent contact with electrical conductors if fingers or other objects are inserted into the receptacles 510. The outlet 300 and locking plug 1200 are keyed to insure the plug 1200 is inserted with the correct orientation and polarization. FIG. 1A illustrates a plug 1200 in an unlocked position with a finger hold 1500 pulled-out. In this position, the plug 1200 can be inserted into or removed from the outlet 300 using the side-mounted finger grips 1410.

FIG. 1B illustrates an interconnected safety electrical connection system 100. The locking plug 1200 is inserted into a covered wall outlet 300 by pressing the plug 1200 against a cover 600, which pushes into the associated receptacle 510. Once the plug 1200 is fully inserted, the finger hold 1500 is pushed in, placing the plug 1200 in the locked position. As the plug 1200 is moved from the unlocked position (FIG. 1A) to the locked position shown, prongs extend from the plug 1200 and into access apertures within the receptacle 510. The prong contacts wipe against and make electrical contact with respective outlet contacts recessed within these access apertures. Further, as the plug 1200 is inserted into the receptacle 510, a plug ground bar wipes against and makes electrical contact with an outlet ground sleeve within the receptacle 510. Also, the extended prongs hold the plug 1200 in the receptacle 510, advantageously preventing inadvertent removal of the plug 1200. The extended prongs only make an electrical connection with the outlet contacts when the plug 1200 is fully inserted and completely enclosed within the receptacle 510, avoiding exposed current-carrying conductors as with conventional AC plugs.

As shown in FIG. 1C, two plugs 1200 can be inserted into a duplex covered outlet 300. The plugs 1200 are rotated 180 degrees relative to each other, maintaining proper plug polarity. The finger holds 1500, which can unlock and lock a plug 1200 with a push or pull action, along with finger grips 1410 provide an ergonomic way to insert and remove the plugs 1200. The locking plugs 1200 can be pre-wired as safety plugs or configured as adapter plugs that accept conventional AC plugs of various sizes.

Figure 1D:
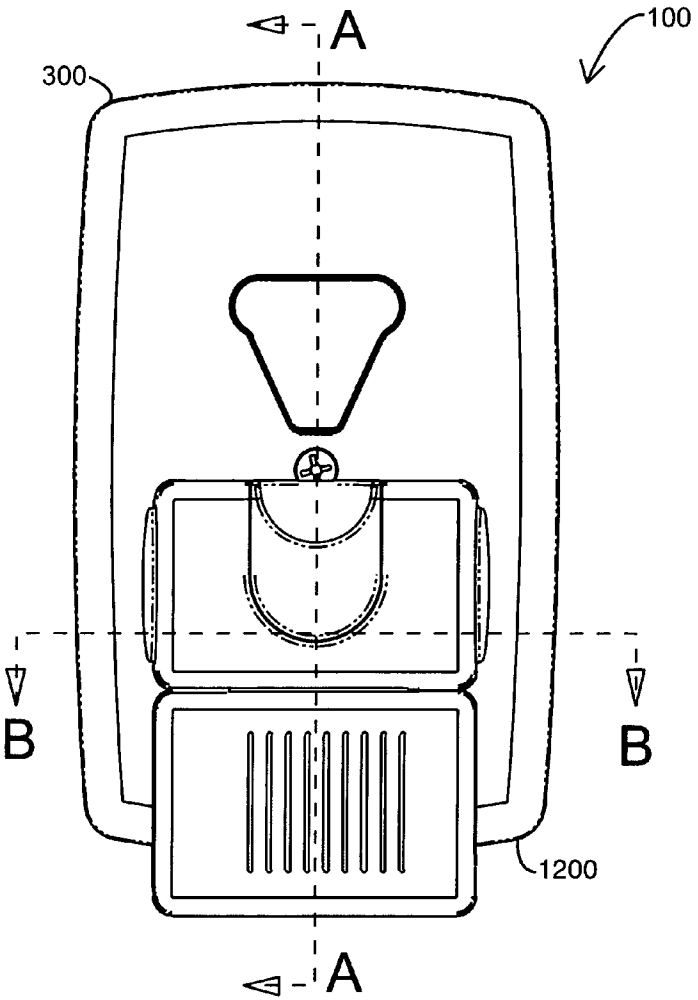
Figure 1E:
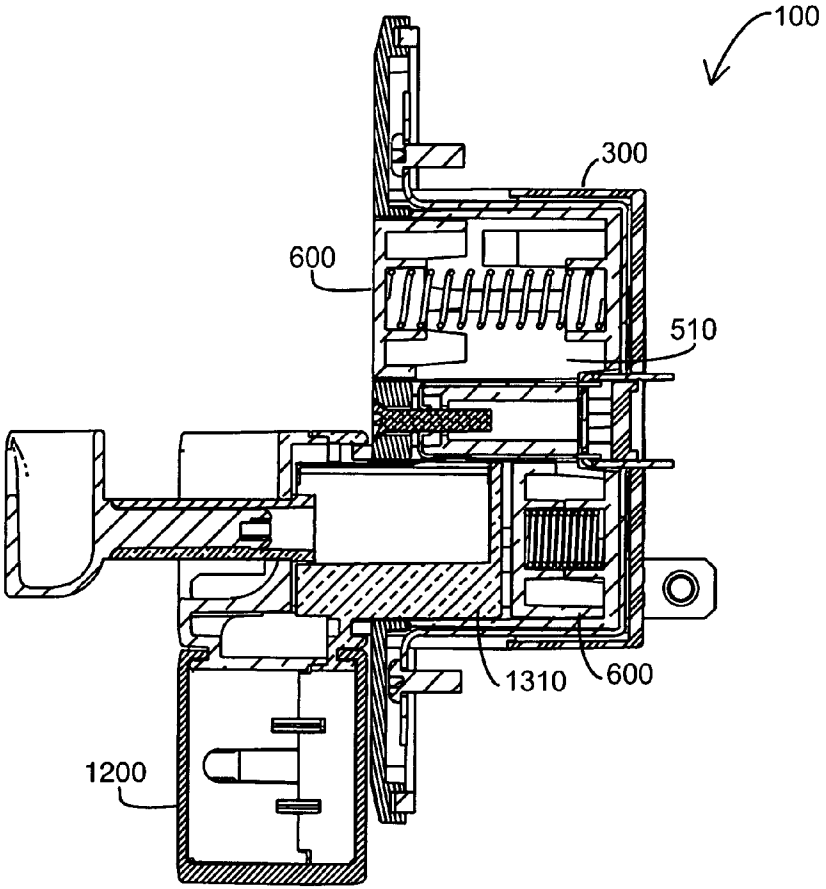
Figure 1F:
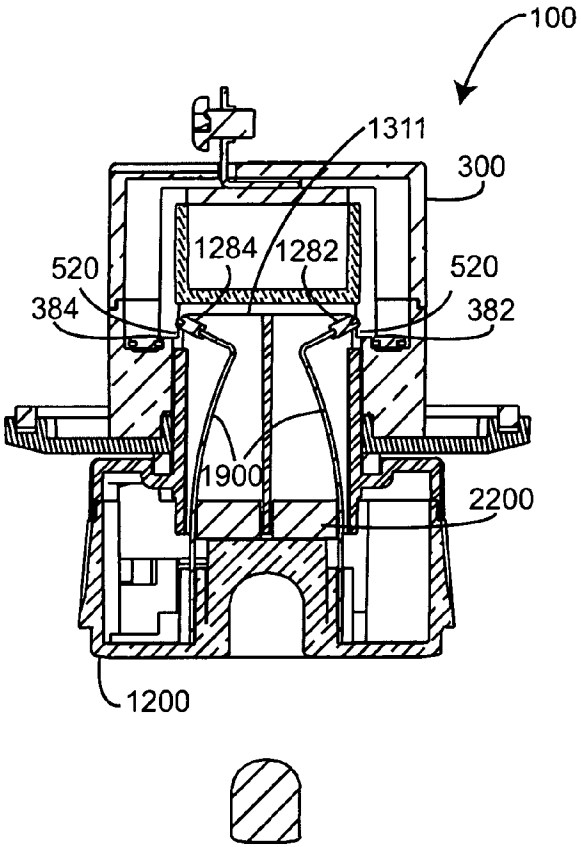

FIGS. 1D–F illustrate top-level internal features of the safety electrical connection system 100. FIG. 1D illustrates a locking plug 1200 inserted into the lower receptacle of a covered outlet 300. The upper receptacle is unused and closed. FIG. 1E illustrates a side view of a cross-section through the upper and lower receptacles. The lower receptacle shows a plug probe 1310 inserted into the receptacle and the receptacle cover 600 pushed to the receptacle bottom, compressing the cover spring. The plug 1200 is shown in the unlocked position with a pulled-out finger hold. The upper receptacle 510 shows a cover 600 urged by the cover spring to a closed position flush with the face plate.

FIG. 1F illustrates a top view of a cross-section through the lower receptacle. As the result of the pulled-out finger hold, the slide 2200 is positioned near the back of the probe and away from the probe face. In this unlocked position, the prongs 1900 are retracted as shown. When the plug is placed in the locked position, the finger hold is pushed in. This positions the slide 2200 near the probe face, forcing the prongs apart and causing the prongs 1900 to extend through the receptacle access apertures 520, locking the plug 1200 in the receptacle and causing the plug contacts 1282, 1284 to connect with the outlet contacts 382, 384.

Covered Electrical Outlet

Figure 2A:
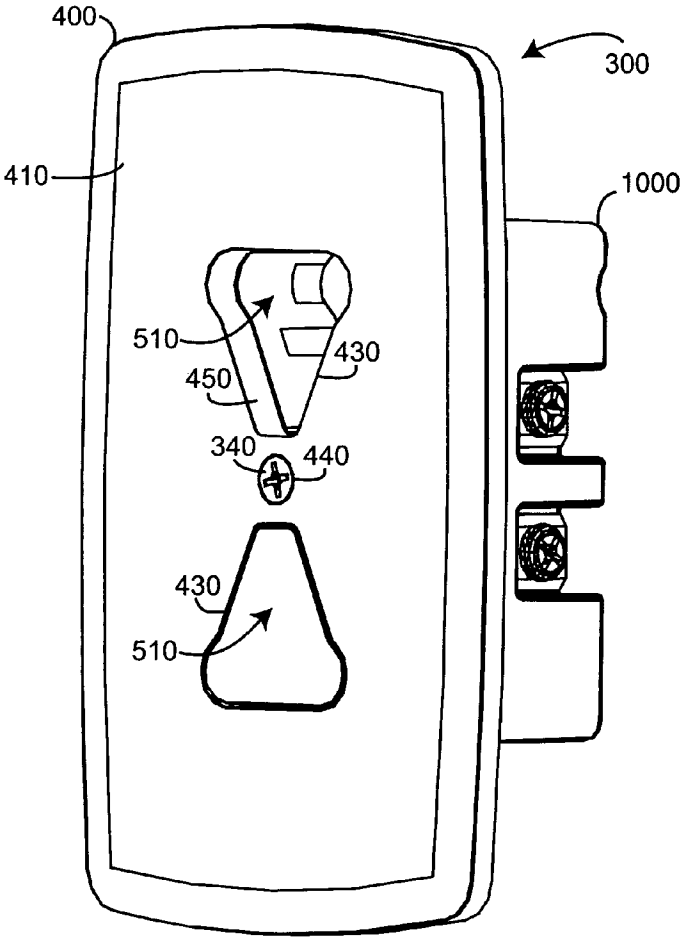
FIGS. 2A–E illustrate detailed features of a covered outlet.
Figure 2B:
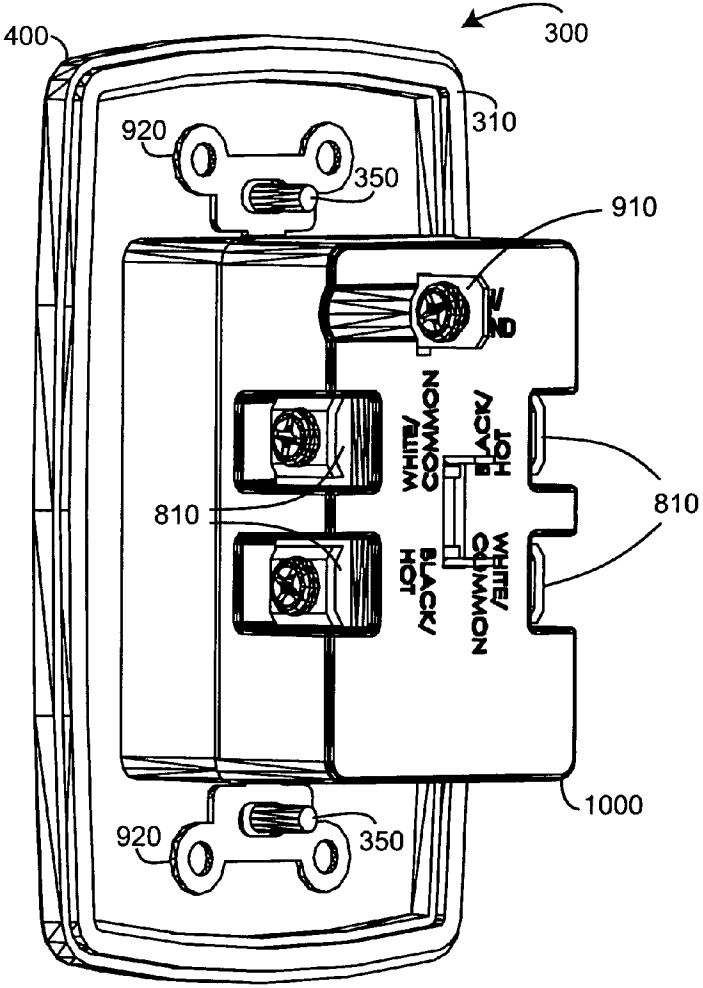

FIGS. 2A–E illustrate further detail of the covered outlet 300. As shown in FIGS. 2A–B, the outlet 300 includes a face plate 400 mounted on the front of, and a rear shell 1000 snapped onto the back of, a receptacle assembly 200 (FIGS. 2C–D), which is thereby substantially concealed. A mounting screw 340 is inserted through a center hole 440 and into the receptacle assembly 200 (FIGS. 2C–D) to hold the face plate 400 in place. Face plate cutouts 430 provide an entrance to receptacles 510. The cutouts 430, covers 600 and the receptacle 510 cross-sections are each keyed so as to prevent the insertion of an improperly oriented locking plug 1200 (FIGS. 11A–F).

FIG. 2A also illustrates an upper receptacle 510 with a cover 600 in an opened position and a lower receptacle 510 with a cover 600 in a closed position. In the closed position, the cover 600 is generally flush with the face plate front-side 410. Closed covers 600 present a relatively featureless surface that is unlikely to attract the attention of small children and that provides an aesthetic, smooth finish to an interior wall. In an open position, a cover 600 is pressed to the bottom of the receptacle 510 to accept a locking plug 1200 (FIGS. 101A–F). The face plate 400 has a raised wall 450 around each cutout 430 that forms the upper portion of each receptacle 510. This raised wall 450 facilitates an environmental seal protecting the outlet components.

FIG. 2B also illustrates the power wiring connectors 810, 910, which are accessible from and labeled at the rear shell 1000. Typically, an electrical box is mounted to a wall stud, and the covered outlet 300 is installed in the box and wired to a power cable after wallboard is in place. The outlet 300 is installed in an electrical box (not shown) with mounting plates 920 and associated screws 350 threaded through the plates 920 and into box mounting posts (not shown). The power cable (not shown) is routed through the back of the electrical box. Hot and neutral (common) wires are connected to the outlet 300 at the hot and neutral connectors 810, as labeled. A ground wire is connected to the outlet 300 at the ground connector 910, as labeled. An installed outlet 300 is completed by attaching the face plate 400 and associated gasket 310.

Figure 2C:
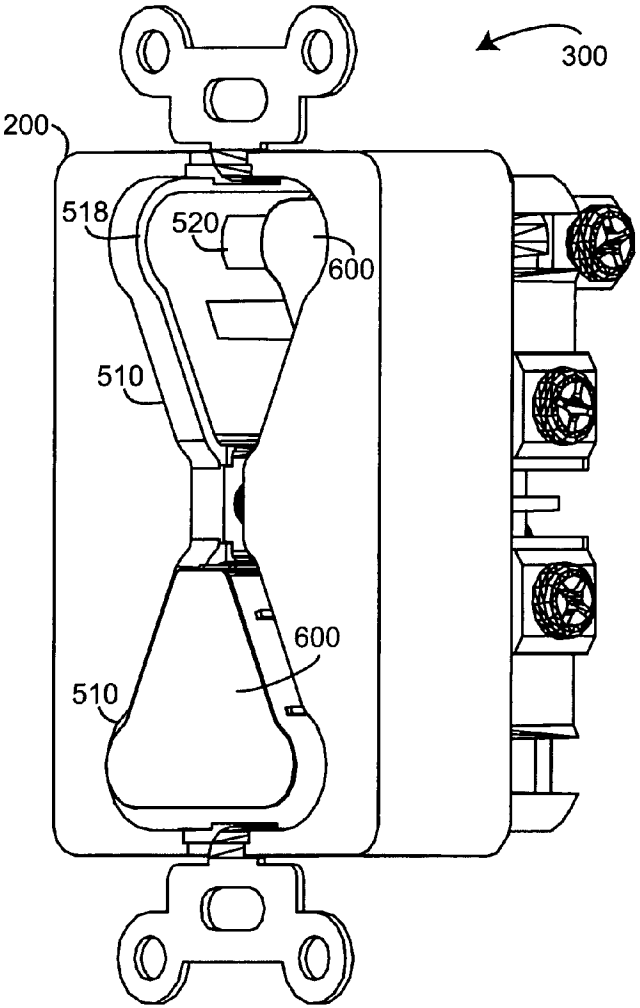

FIG. 2C illustrates the front portion of the receptacle assembly 200. The receptacle assembly 200 has an outlet housing 500 with two receptacles 510. Inside each receptacle are two access apertures 520 near the bottom of the receptacle 510. These access apertures 520 are recessed from the surface of the wall in which the outlet 300 is installed. The access apertures 520 are hidden by a spring-loaded cover 600 and revealed only when the cover 600 is moved from a closed position (as shown in the lower receptacle 510) to an open position (as shown in the upper receptacle 510), such as when a locking plug 1200 (FIGS. 11A–F) is inserted. The access apertures 520 accept prongs that extend from the plug 1200 (FIGS. 1A–F) through the access apertures 520 to electrically connect with outlet hot and neutral contacts. Thus, the outlet contacts are advantageously shielded, only accessible through these small access apertures 520 at the bottom of the receptacle, substantially recessed behind the wall in which the receptacle assembly is installed and hidden by closed covers. Also shown in FIG. 2C, a recessed shelf 518 is located around the periphery of each receptacle 510. The shelf 518 is configured to accepted a corresponding face plate wall portion 450 (FIG. 2A), as described above.

Figure 2D:
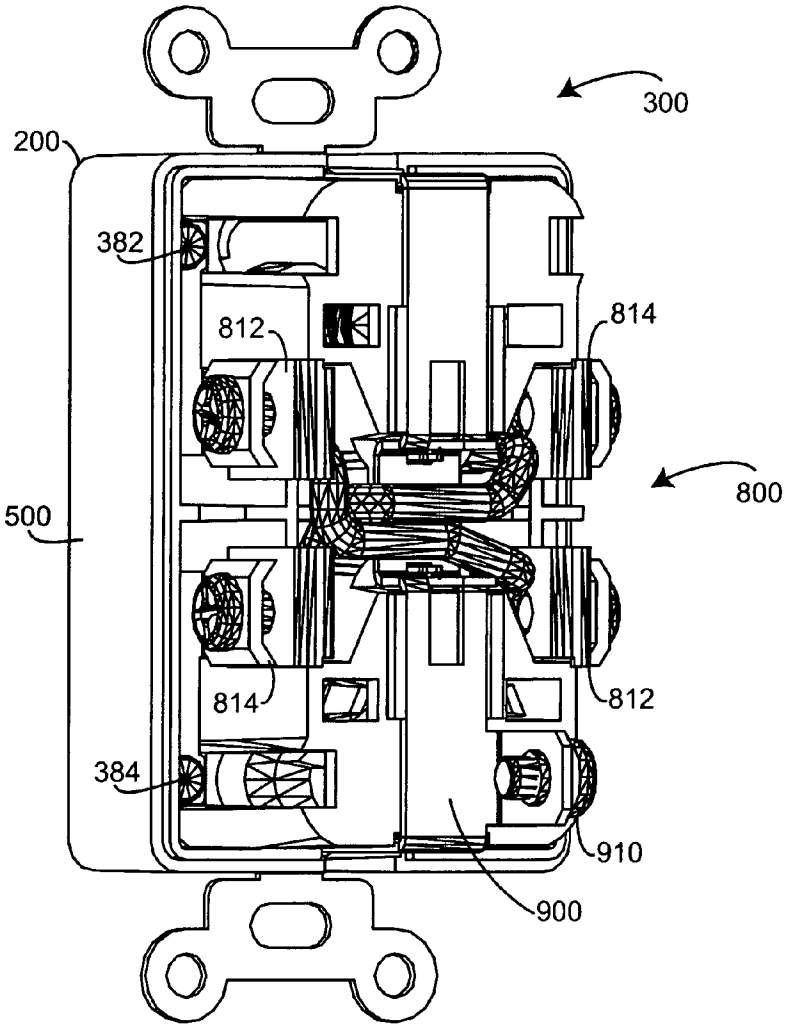

FIG. 2D illustrates the back portion of the receptacle assembly 200. The outlet housing 500 has a back face 502 structured to retain the outlet current carrying busses 800 and a bracket 900 that functions as a ground buss. These busses 800 and bracket 900 have connectors that attach the wires of an external power cable. In particular, an external ground wire attaches to the bracket ground connector 910, external neutral wires attach to the neutral (common) buss connectors 812, one for each receptacle 510 and external hot wires attach to the hot buss connectors 814, also one for each receptacle 510. The busses 800 provide conductivity between the external wire connectors 812, 814 and outlet contacts 382, 384.

Figure 2E:
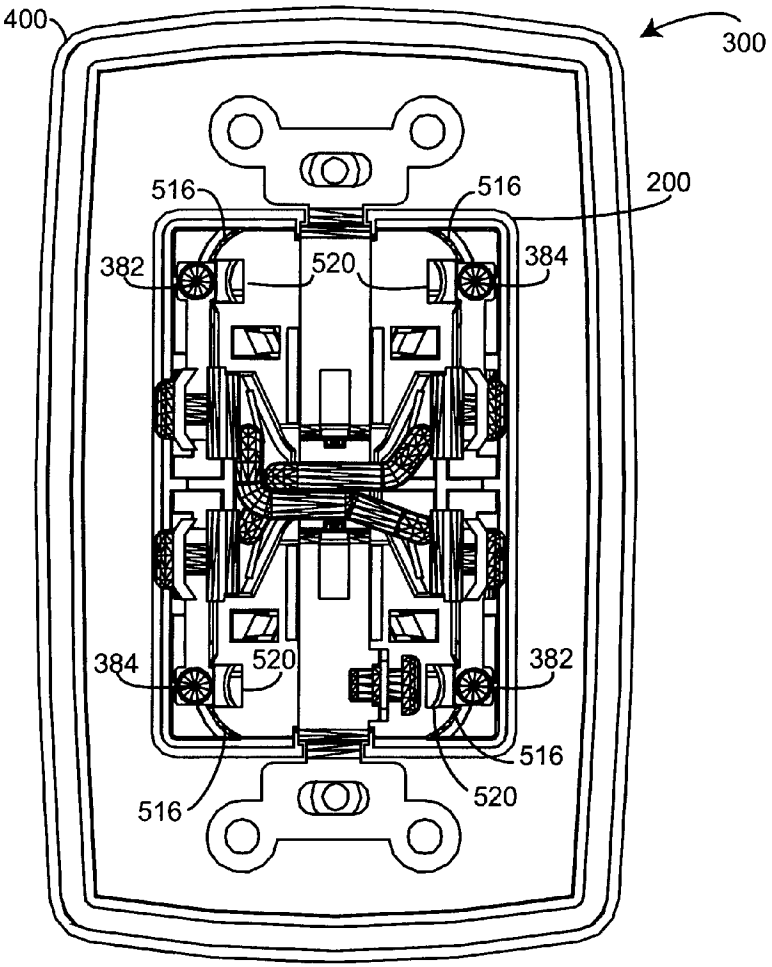

FIG. 2E illustrates the back of the outlet 300. The outlet neutral 382 and hot 384 contacts are positioned along the receptacle outer wall 516 and adjacent the access apertures 520. The contacts are advantageously mounted adjacent the front of the apertures 520 as viewed from the face plate front side 410 (FIG. 2A). In this manner, a foreign object inserted into a receptacle 510 must be pushed through an access aperture 520 and curved back toward the receptacle opening in order to touch the contacts. This provides further protection against inadvertent exposure to current carrying conductors in the outlet 300.

Covered Outlet Components

Figure 3A:
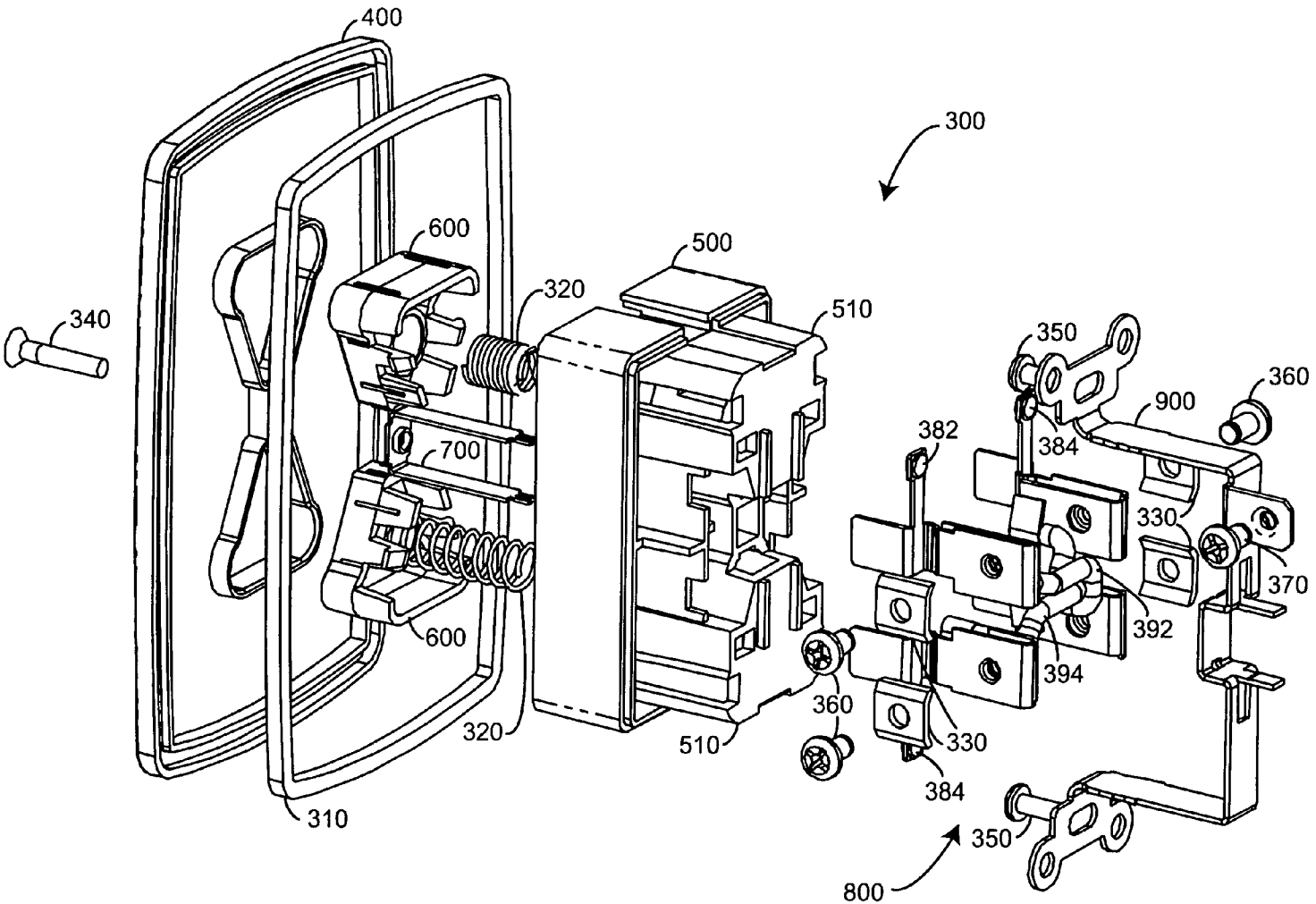
FIGS. 3A–B are an exploded, back perspective view of a covered outlet assembly.
Figure 3B:
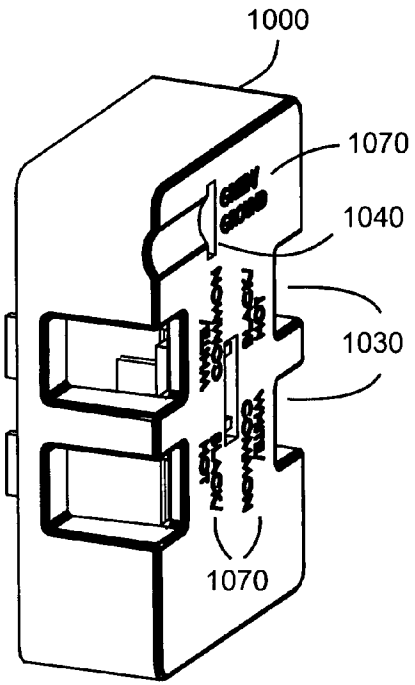
Figure 4A:
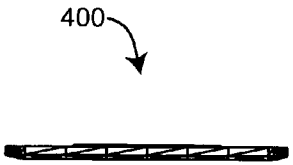
FIGS. 4A–E are top, perspective, front, side and back views of a face plate.
Figure 4B:
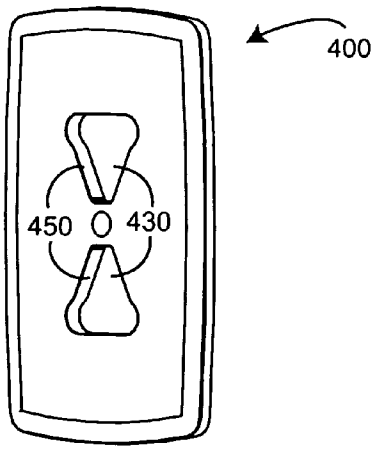
Figure 4C:
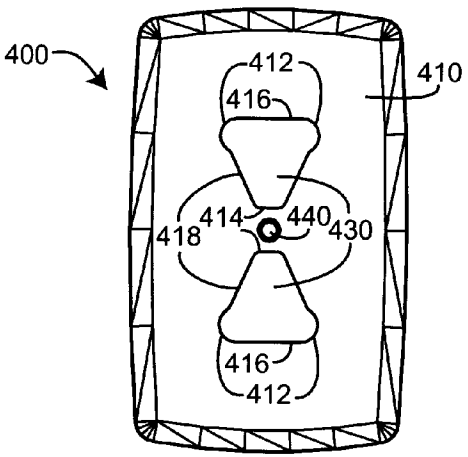
Figure 4D:
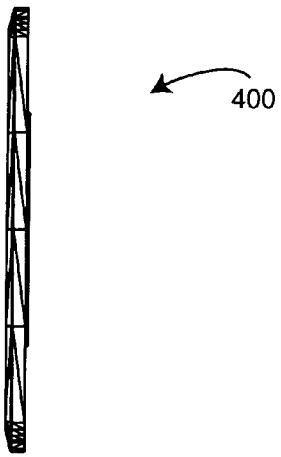
Figure 4E:
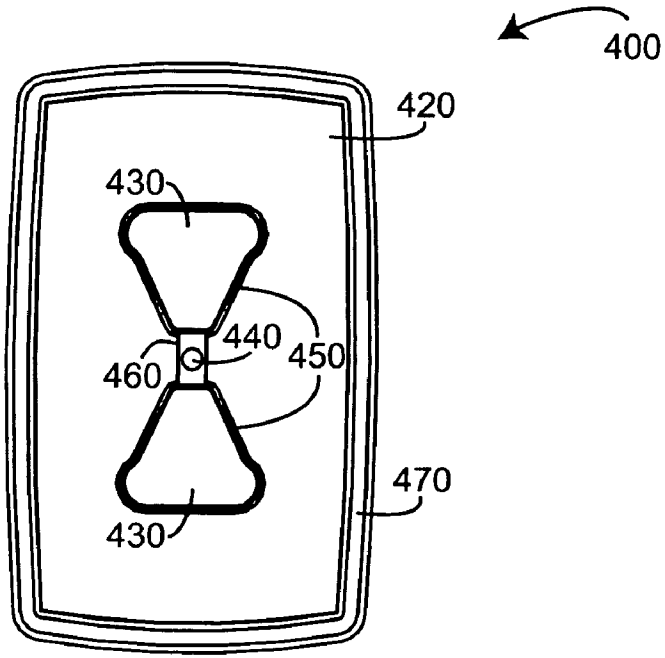

FIGS. 3A–B illustrate the various components of an outlet assembly. The outlet 300 has a face plate 400, an outlet housing 500, covers 600, a ground sleeve 700, hot and neutral busses 800, a bracket 900 and a rear shell 1000. As shown in FIG. 3A, the face plate 400 provides an aesthetic wall trim that covers the remainder of the outlet 300. The outlet 300 is environmentally sealed by the face plate 400, which advantageously mates inside the outlet housing 500, a face plate gasket 310 installed around the face plate periphery and the self-closing covers 600. The face plate 400 attaches to the outlet housing 500 with a screw 340, which also secures the ground sleeve 700 to the outlet housing 500. The face plate 400 is described in further detail with respect to FIGS. 4A–E, below.

Also shown in FIG. 3A, the outlet housing 500 defines dual receptacles 510 (outer walls illustrated) that each accept locking plugs 1200 (FIGS. 11A–F) and retain the covers 600. The outlet housing 500 also retains the ground sleeve 700 and hot and neutral busses 800. In addition to sealing the receptacles, the covers 600 and associated springs 320 advantageously provide a physical blocking mechanism that discourage child access to the outlet contacts 382, 384. The outlet housing 500 is described in further detail with respect to FIGS. 5A–E, below. The covers 600 are described in further detail with respect to FIGS. 6A–E, below.

Further, FIG. 3A illustrates the ground sleeve 700 and current busses 800. These conductors 700, 800 provide an electrical path between an external power source that is wired to the rear of the outlet 300 and an inserted plug 1200 (FIGS. 11A–F). In particular, the ground sleeve 700 provides ground contacts for plugs 1200 (FIGS. 11A–F) inserted into the receptacles 510 and a ground path to the bracket 900. The current busses 800 include two neutral busses and two hot busses. The upper busses provide neutral and hot contacts 382, 384 to the upper receptacle 510. Likewise, the lower busses provide neutral and hot contacts 382, 384 to the lower receptacle 510. The busses 800 also provide connectors for external power wires attached to the busses 800 using wire clamps 330 and screws 360. The ground sleeve 700 is described in further detail with respect to FIGS. 7A–D, below. The busses 800 are described in further detail with respect to FIGS. 8A–E, below.

In addition, FIG. 3A shows that the busses 800 are positioned at diagonal corners of the outlet housing 500 and electrically coupled with neutral 392 and hot 394 jumpers. This diagonal positioning of the current busses 800 and the corresponding jumpers 392, 394 accommodate the polarization of the plugs 1200 (FIGS. 11A–F), which are relatively rotated 180° for insertion in opposite outlet receptacles 510, as shown in FIG. 1C. The corresponding neutral 382 and hot 384 contacts are located on different sides of each receptacle 510, accordingly.

FIG. 3A also illustrates the bracket 900, which provides a mount for the outlet 300 to install within a standard electrical box. Further, the ground sleeve 700 connects to the bracket 900, which provides a ground connector for an external ground wire using a screw 370. The bracket 900 is attached to an electrical box using screws 350. The bracket 900 is described in further detail with respect to FIGS. 9A–D, below.

As shown in FIG. 3B, the rear shell 1000 mates with the rear portion of the outlet housing 500, and provides environmental protection to the current carrying busses 800. External power and ground connectors are exposed through openings 1030, 1040. Descriptive labeling 1070 is provided on the back of the rear shell 1000 as a guide for external wiring. The rear shell 1000 is described in further detail with respect to FIGS. 10A–D, below.

Face Plate

FIGS. 4A–E illustrate the face plate 400, which provides a wall trim when attached to the outlet housing front 501 (FIGS. 5A–E). The face plate 400 has a front side 410, a back side 420, two cutouts 430 and a center hole 440. The face plate 400 is attached with a screw or equivalent securing device threaded through the center hole 440 and into the housing center post 560 (FIGS. 5A–E). In one embodiment, the face plate 400 is a nonconductive component, meaning that there are no contacts, conductive surfaces or equivalent electrical current carrying portions mounted to, deposited onto or otherwise incorporated on or within the face plate 400. The covered outlet 300 (FIGS. 2A–E) and corresponding locking plug 1200 (FIGS. 11A–F) are a fully-functional electrical connection system without the face plate 400.

As shown in FIGS. 4A–E, the cutouts 430 are keyed to facilitate orientation of a locking plug 1200 (FIGS. 11A–F) and correspond in size and shape to the outlet receptacles 510 (FIGS. 5A–E). In one embodiment, the cutouts 430 are keyed with a generally triangular shape. In a particular embodiment, the triangular shape has two rounded corners 412, a squared apex 414, a base 416 between the corners 412, and two sides 418 between the corners 412 and the apex 414. The apex 414 of each cutout 430 is proximate, and the base 416 of each cutout 430 is distal the center hole 440.

Also shown in FIGS. 4A–E, the face plate 400 has a raised wall 450 extending normal to the back side 420 and around the periphery of the cutouts 430. With the face plate 400 mounted to the outlet housing 500 (FIGS. 5A–E), the raised wall 450 mates with a recessed shelf 518 (FIGS. 5A–E) within each receptacle 510 (FIGS. 5A–E). In this manner, the face plate 400 integrates with each receptacle 510 (FIGS. 5A–E) creating a continuous receptacle inner surface without gaps or openings between the face plate 400 and the outlet housing 500 (FIGS. 5A–E). Advantageously, the raised wall 450 helps seal the receptacles 510 (FIGS. 5A–E) from environmental conditions such as dust, debris, corrosive elements and hazardous gases and provides for a smooth movement of the covers 600 (FIGS. 6A–E). The face plate 400 also has a raised portion 460 extending normal to the back side 420 and disposed around the center hole 440. This supports the mounting screw 340 (FIG. 3A) and retains the ground sleeve 700 (FIGS. 7A–D) within the outlet housing 500 (FIGS. 5A–E).

Outlet Housing

FIGS. 5A–E illustrate an outlet housing 500, which has a generally rectangular cross-section. The outlet housing 500 has a generally planar front face 501 and a structured back face 502. The outlet housing 500 defines two enclosed receptacles 510, each with an opening 503 at the front face 501. In one embodiment, the receptacles are keyed with a generally triangular cross-section with rounded corners and a squared apex corresponding to the face plate cutouts 430 (FIGS. 4A–E), described above. Inside the receptacles 510 is an inner wall 512 extending to a closed bottom 514. Outside the receptacles 510 is an outer wall 516 extending to the back face 502. The inner wall 512 has a shelf 518 near the front face 501 that mates with a face plate raised wall 450 (FIGS. 4A–E). A cylindrical spring holder 540 extends from the bottom 514 to retain cover springs 320 (FIG. 3A) that urge receptacle covers 600 (FIGS. 6A–E) to a closed position.

As shown in FIGS. 5A–E, two access apertures 520 are located along the inner wall 512 and near the bottom 514 of each receptacle 510. In a particular embodiment, these apertures 520 are recessed 0.594 inches from the front face 501. Thus, including the face plate thickness, the apertures 520 are recessed at least about 0.6 inches from the face plate cutouts 430 (FIGS. 4A–E). Locking plug prongs 1900 (FIGS. 9A–E) extend through these apertures 520 to contact outlet contacts 382, 384 (FIG. 3A) that rest against contact structure 552 along the outer wall 516 adjacent the access apertures 520. The outlet contacts 382, 384 (FIG. 3A) are mounted on hot and neutral busses 800 (FIGS. 8A–E) inserted along the back face 502. In particular, the housing 500 retains the busses 800 (FIGS. 8A–E) by inserts 840 (FIGS. 8A–E) that are pressed into insert structure 554 and buss clips 850 (FIGS. 8A–E) that are pressed over clip structure 556.

FIGS. 5A–E further show that two channels 530 are also located along each receptacle inner wall 512 extending from the bottom 514 to an end 532 near the shelf 518. The channels 530 accommodate cover catches 640 (FIGS. 6A–E) that stop at the ends 532 to retain spring-loaded covers 600 (FIGS. 6A–E) within the receptacles 510.

Also shown in FIGS. 5A–E is a center post 560 having a post hole 562 for attaching a face plate 400 (FIGS. 4A–E) and securing a ground sleeve 700 (FIGS. 7A–D). Adjacent the center post 560 are slots 564 for inserting the ground sleeve 700 (FIGS. 7A–D). Grooves 570 are located along the housing top 504 and bottom 505 and bracket structure 580 is located on the back face 502 adjacent the center post 560 to secure a bracket 900 (FIGS. 9A–D).

Receptacle Cover

FIGS. 6A–E illustrate a receptacle cover 600, which has a front face 610, an open bottom face 620 and walls 630 extending along the periphery of the front face 610. The cover 600 is keyed in a manner consistent with the face plate cutouts 430 (FIGS. 4A–E) and the cross-section of the receptacles 510 (FIGS. 5A–E). In a particular embodiment, the cover cross-section is generally triangular shaped with round corners 612 and a squared apex 614, as described with respect to the face plate cutouts 430 (FIGS. 4A–E), above. The cover 600 has two flexible catches 640, one on each side between the corners 612 and the apex 614, each with a surface 642 parallel to the front face 610. A cylindrical spring holder 650 extends in a normal direction from the bottom face 620. A cover 600 is loaded into a receptacle 510 (FIGS. 5A–E) by placing a spring in the spring holder 650, inserting the spring and the cover 600 into the receptacle 510 (FIGS. 5A–E), bottom face 620 first, compressing the catches 640 toward the cover and pressing the cover 600 into the receptacle 510 (FIGS. 5A–E) so that the catches 640 snap into the channels 530 (FIGS. 5A–E). The covers 600 are slidably retained within the receptacles 510 (FIGS. 5A–E). When pressed into a receptacle 510 (FIGS. 5A–E), the travel of the cover 600 is limited by extensions 650 hitting the receptacle bottom 514 (FIGS. 5A–E). When released, the travel of the cover 600 is limited by the catches 640 contacting the channels ends 532 (FIGS. 5A–E).

Ground Sleeve

Figure 5B:
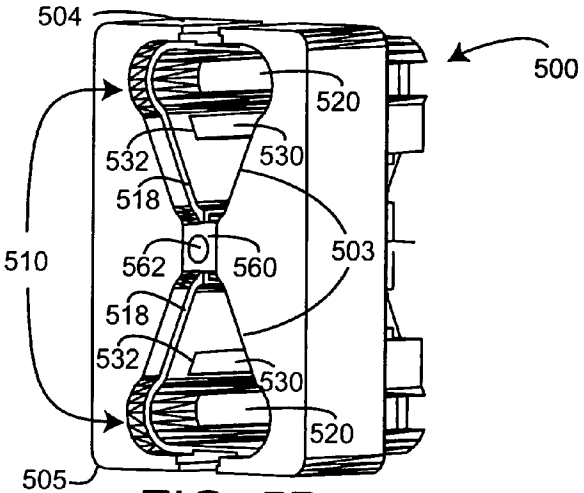
FIGS. 5A–E are top, perspective, front, side and back views of an outlet housing.
Figure 5D:
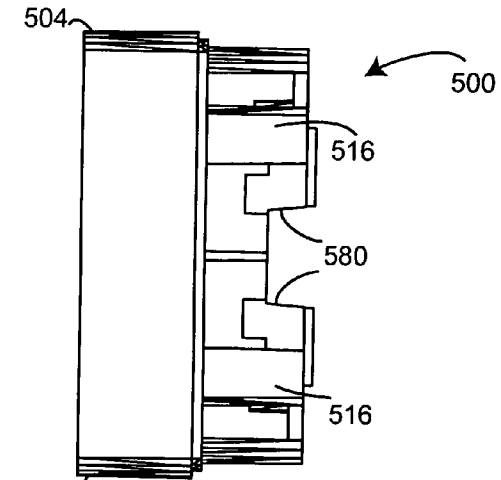
Figure 5A:
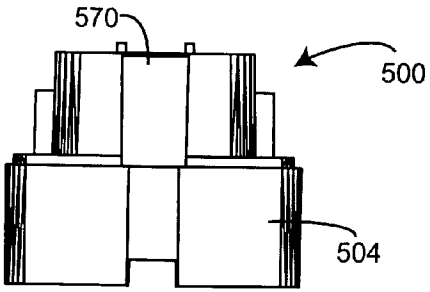
Figure 5C:
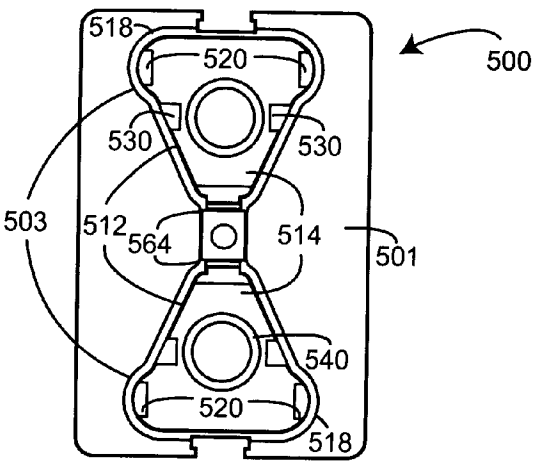
Figure 5E:
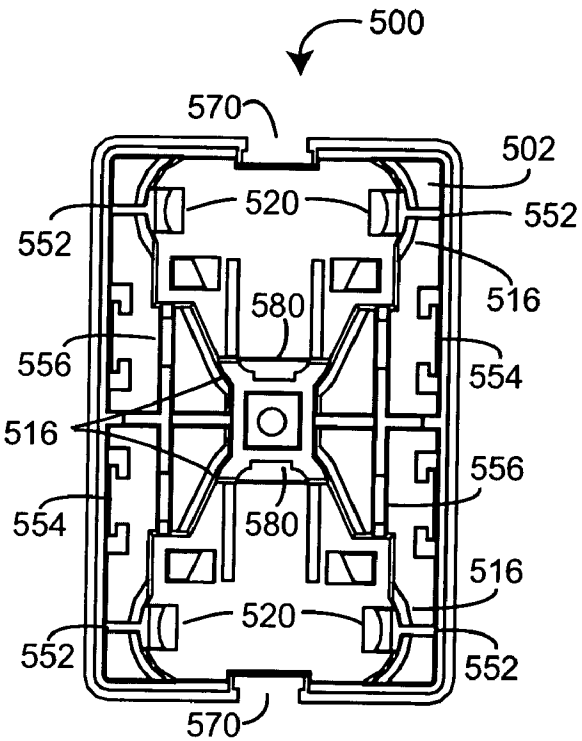
Figure 6A:
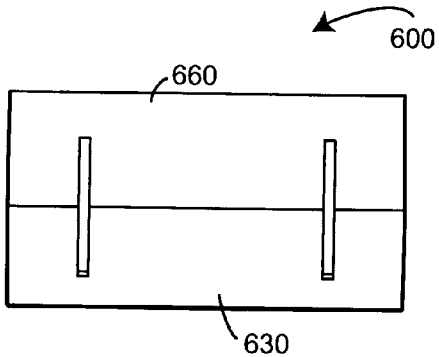
FIGS. 6A–E are top, perspective, front, side and back views of a receptacle cover.
Figure 6B:
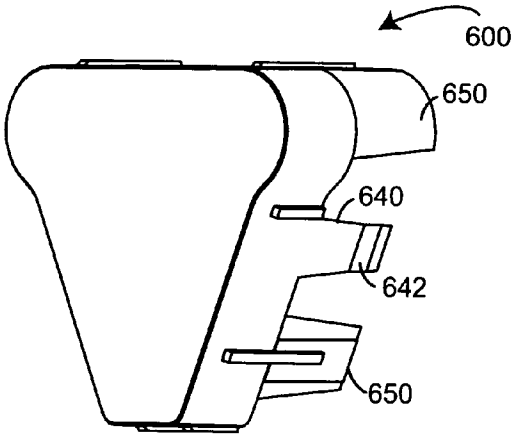
Figure 6C:
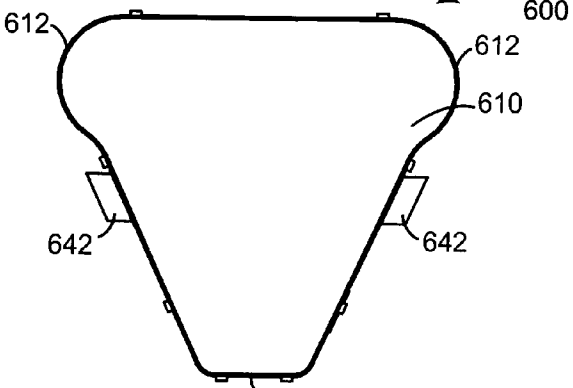
Figure 6D:
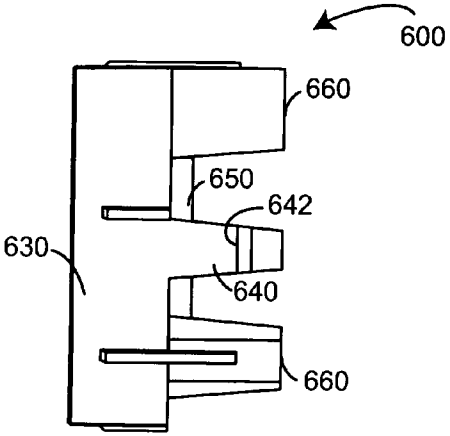
Figure 6E:
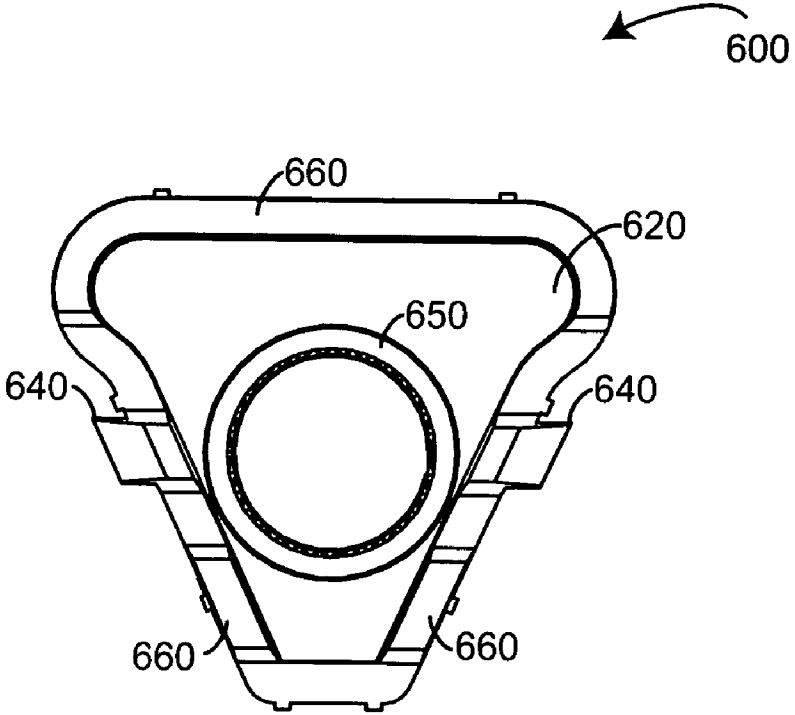
Figure 7A:
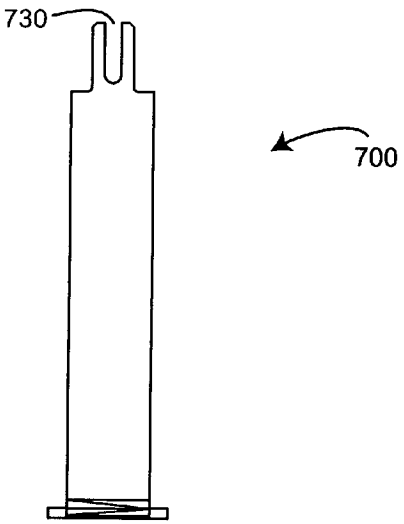
FIGS. 7A–D are top, perspective, front and side views of a ground sleeve.
Figure 7B:
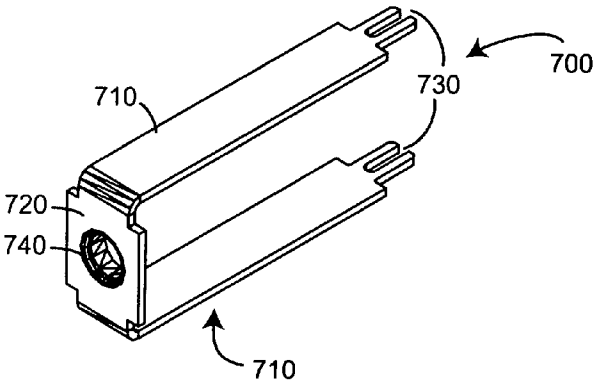
Figure 7C:
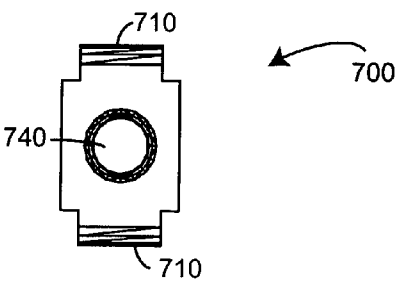
Figure 7D:
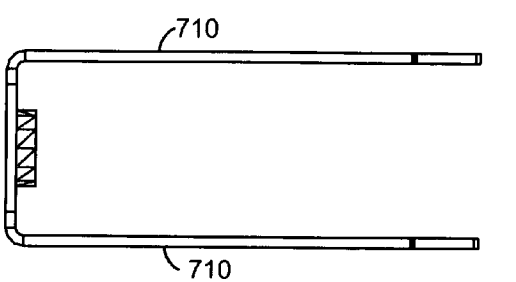

FIGS. 7A–D illustrate the ground sleeve 700, which has top and bottom ground contacts 710, a center section 720 joining the contacts 710 at one end, stakes 730 at the other end of the contacts 710, opposite the center section 720 and a mounting hole 740 through the center section 720. The ground sleeve 700 fits through slots 564 (FIGS. 5A–E) in the housing front face 501 (FIG. 5C) so that the center section 720 aligns with a center post 560 (FIGS. 5A–E) and the mounting hole 740 aligns with a post hole 562 (FIG. 5B). The top and bottom contacts 710 line the receptacles 510 (FIGS. 5A–E) along each apex so that the contacts 710 will connect with a plug ground bar 1700 (FIGS. 17A–D). The stakes 730 are swaged into bracket slots 940 (FIGS. 9A–D), electrically connecting the bracket external ground connector 910 (FIGS. 9A–D) and the ground sleeve contacts 710.

The ground sleeve 700 is held in place by the face plate mounting screw 340, which is threaded through the face plate center hole 440 (FIGS. 4A–D), the ground sleeve mounting hole 740 and the housing post hole 562 (FIG. 5B).

Hot and Neutral Buss

Figure 8A:
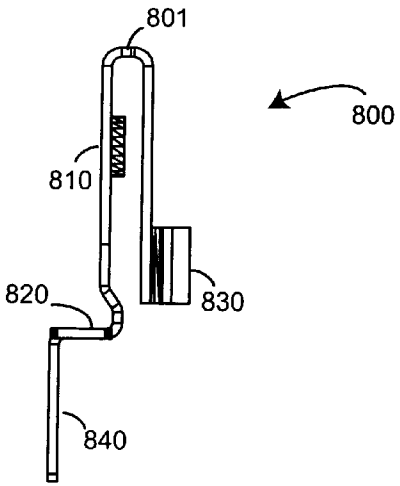
FIGS. 8A–D are top, perspective, front and side views of a hot buss.
Figure 8B:
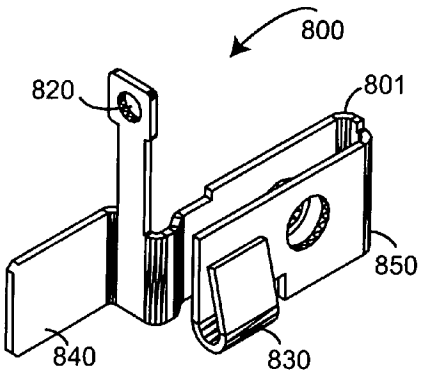
Figure 8C:
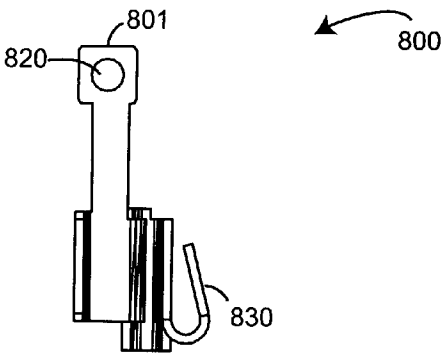
Figure 8D:
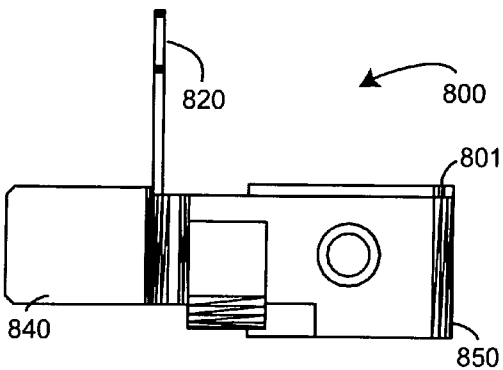
Figure 8E:
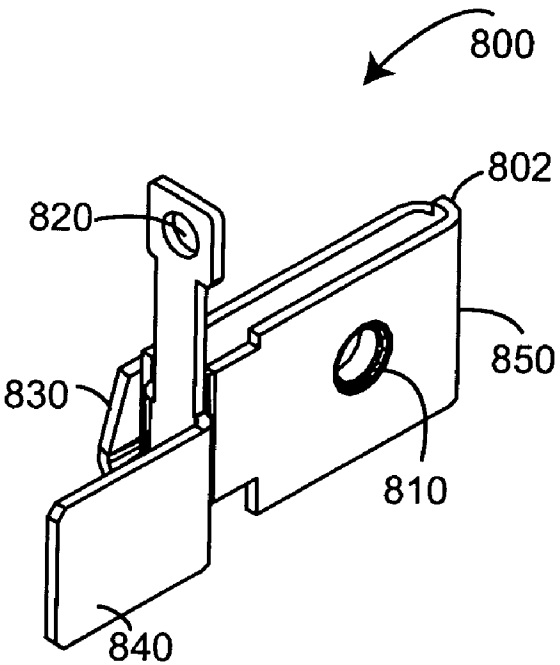
FIG. 8E is a perspective view of a neutral buss.
Figure 9B:
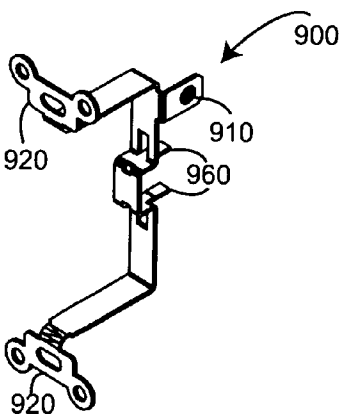
FIGS. 9A–D are top, perspective, front and side views of a bracket.
Figure 9D:
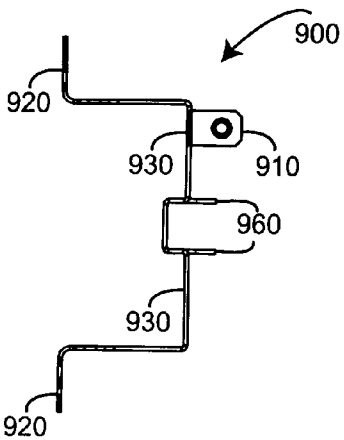
Figure 9A:
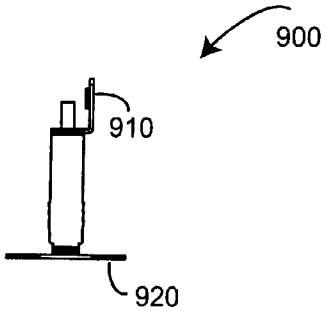
Figure 9C:
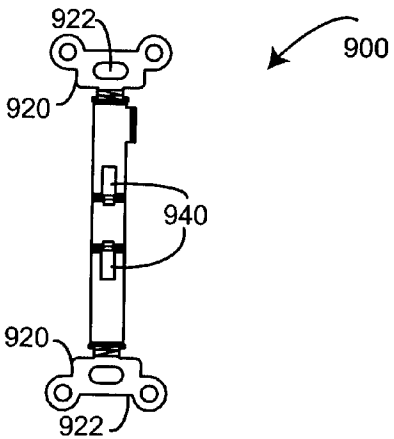
Figure 10B:
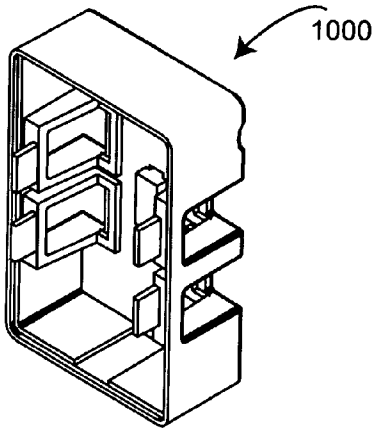
FIGS. 10A–D are top, perspective, front and side views of a rear shell.
Figure 10D:
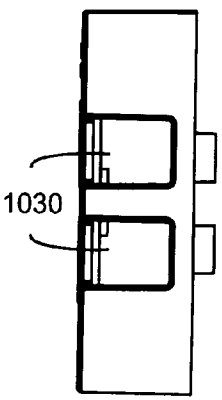
Figure 10A:
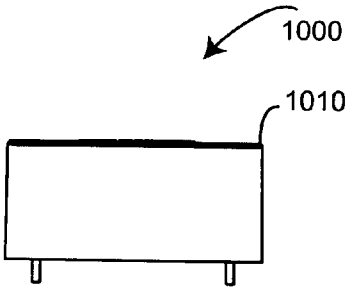
Figure 10C:
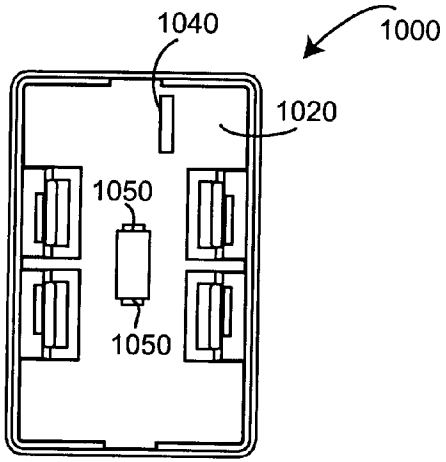

FIGS. 8A–E illustrate contact busses 800. FIGS. 8A–D illustrate a hot buss 801. FIG. 8E illustrates a neutral buss 802, which is a mirror image of the hot buss 801, as illustrated. Four contact busses 800 are used as hot and neutral conductors between external power wiring and the outlet contacts 382, 384 (FIG. 3A). A contact buss 800 has a connector 810, a contact holder 820, a crimp 830, an insert 840 and a "U"-shaped clip 850. The outlet contact 380 is a conductor such as silver and is attached to the contact holder 820 using a swage process. An external hot or neutral power wire is connected to the connector 810 using a screw 360 (FIG. 3A) threaded through a clamp 330 (FIG. 3A). An outlet 300 (FIGS. 2A–E) can be wired full-hot or half-hot. For example, half-hot wiring allows one receptacle to be controlled by a wall switch. For fill-hot wiring, neutral and hot jumpers 392, 394 (FIG. 3A) are installed between individual busses 800. Each end of a jumper 392, 394 (FIG. 3A) is connected to a crimp 830, such as with a resistance weld. A contact buss 800 is installed in the housing back face 502 (FIGS. 5A–E) by pressing the insert 840 into and the clip 850 over corresponding housing structure.

Bracket

FIGS. 9A–D illustrate the bracket 900. The bracket 900 is generally "U"-shaped and functions to secure the outlet 300 within a standard electrical box and provides a ground buss. The bracket 900 has a ground connector 910, upper and lower mounting plates 920, mounting holes 922 centered within the plates 920, upper and lower clips 930, stake slots 940 and crimps 960. A mounting plate 920 is located at each end of the bracket 900. The outlet 300 (FIGS. 2A–E) is mounted to an electrical box with mounting screws 350 (FIG. 3A) threaded through the mounting holes 922 and into box posts (not shown). The bracket 900 attaches to the housing back face 502 (FIGS. 5A–E) with clips 930 around the outside of the receptacle structure. Crimps 960 insert into and fold over to retain the rear shell 1000. Ground sleeve stakes 730 (FIGS. 7A–D) are swaged into the slots 940 to electrically connect the ground sleeve 700 (FIGS. 7A–D) to the bracket 900. An external ground wire is attached to the bracket connector 910 with a ground screw 370.

Rear shell

FIGS. 10A–D illustrate the rear shell 1000, which has a back face 1010 and an open front face 1020. The front face 1020 fits over the outlet housing 500 (FIGS. 5A–E). Bracket crimps 960 (FIGS. 9A–D) fit through slots 1050 and are folded onto the back face 1010 to secure the rear shell 1000 to the housing 500 (FIGS. 5A–E). Side openings 1030 provide access to buss connectors 810 (FIGS. 8A–E). A back opening 1040 provides access to the ground connector 910 (FIGS. 9A–D).

Locking Plug

Figure 11A:
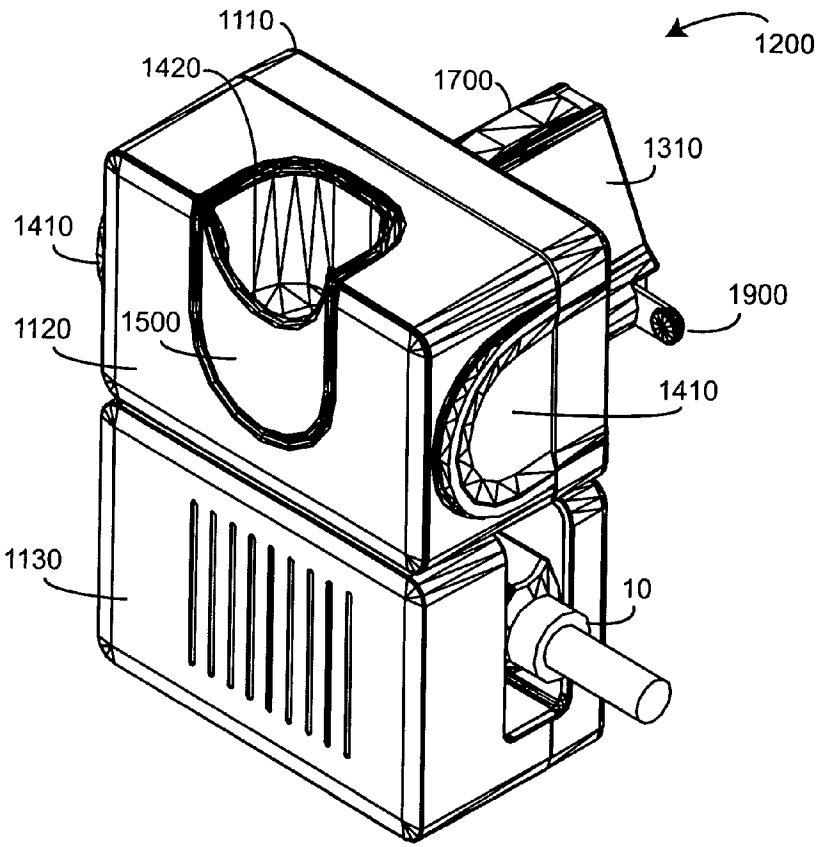
FIGS. 11A–F illustrate detailed features of a locking plug.
Figure 11B:
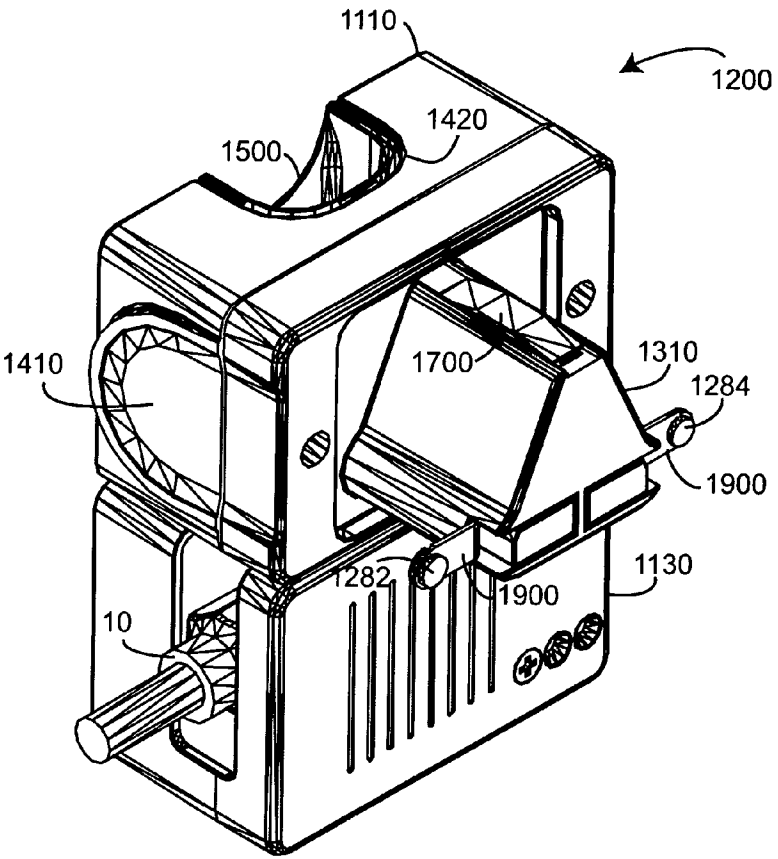
Figure 11C:
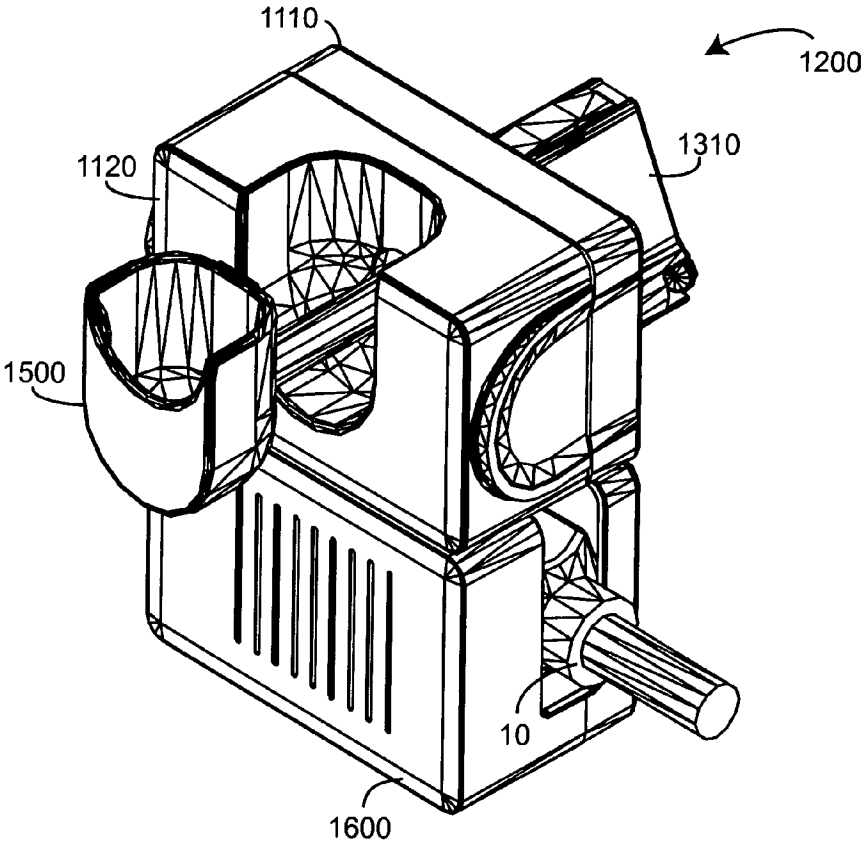
Figure 11D:
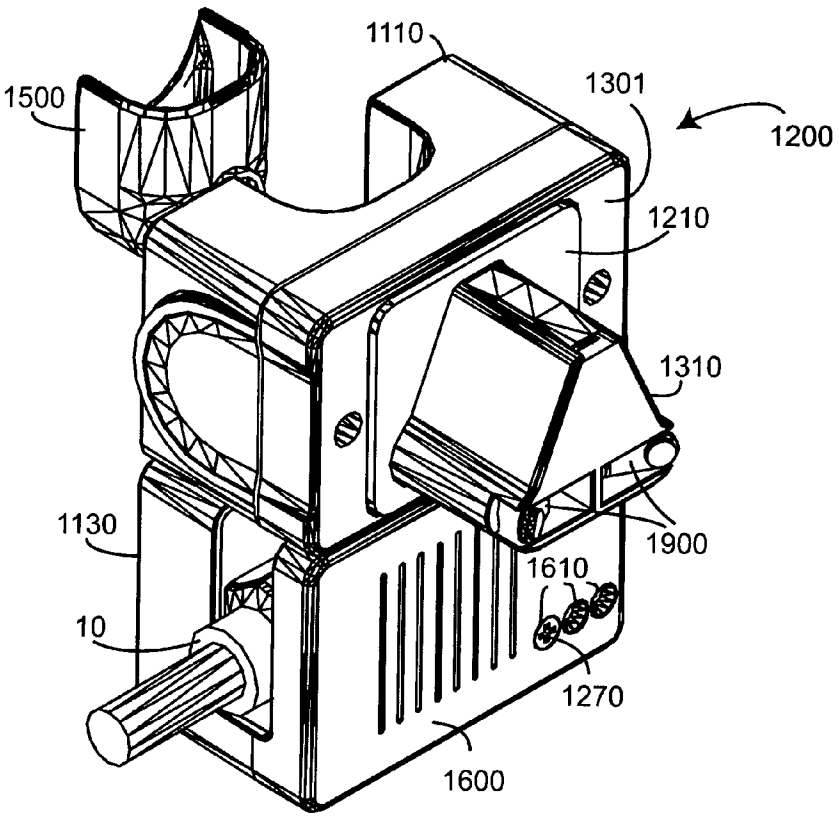
Figure 11E:
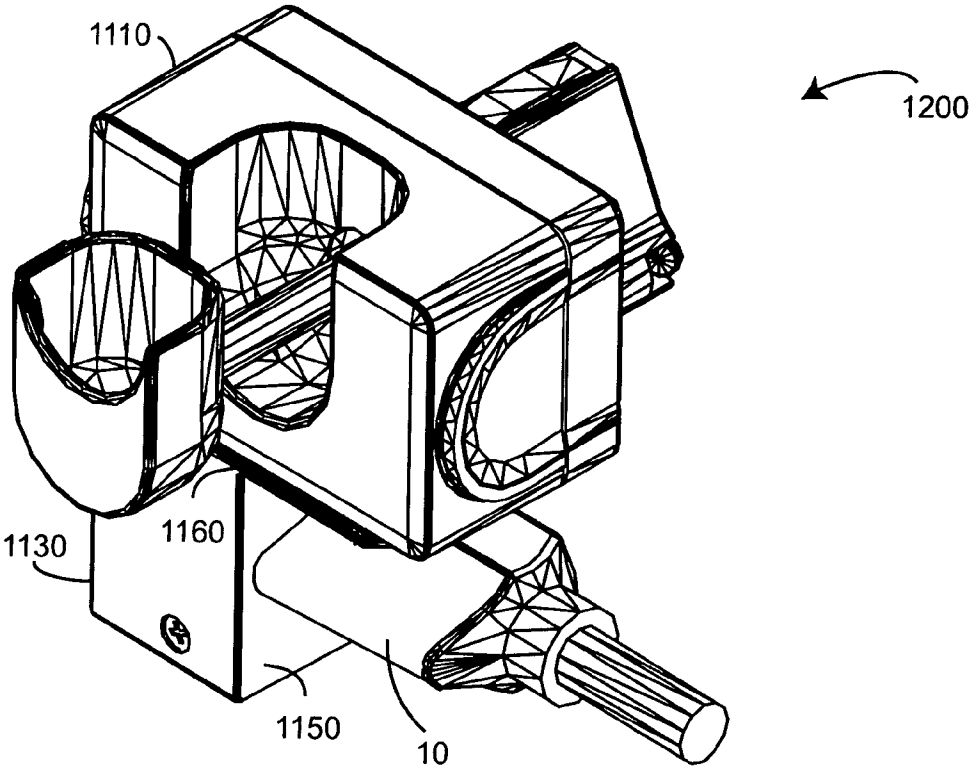
Figure 11F:
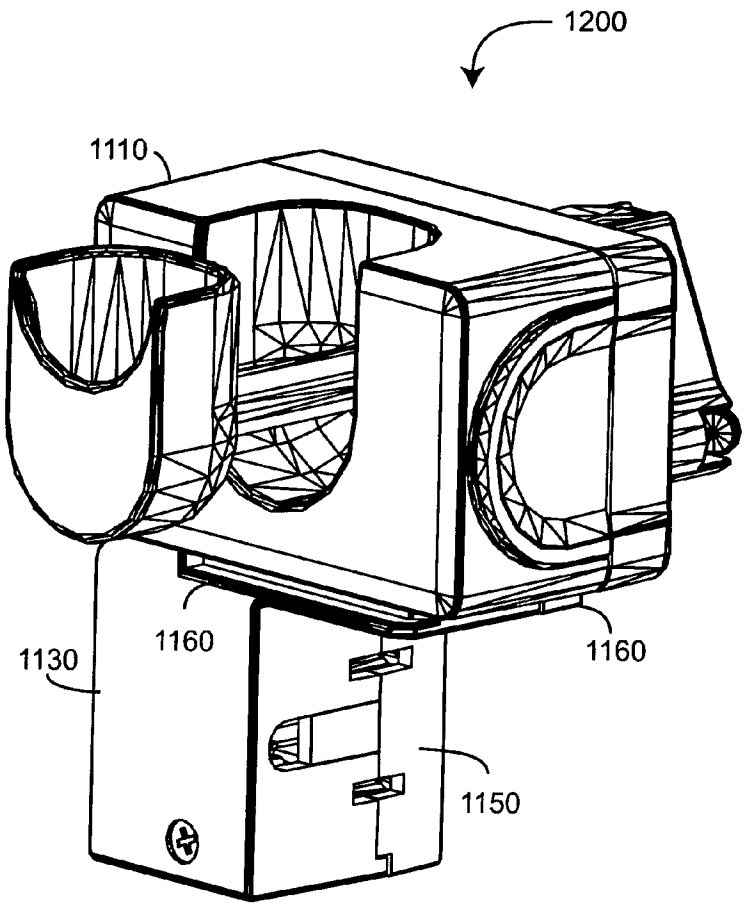

FIGS. 11A–F illustrate further detail of the locking adapter plug 1200. FIGS. 11A–B illustrate the plug 1200 in the locked position. FIGS. 11C–D illustrate the plug 1200 in the unlocked position. FIGS. 11E–F illustrate the plug 1200 with the door 1600 removed. As shown in FIGS. 11A–B, the plug 1200 has a probe 1310 and a case 1110. The case 1110 is divided into upper 1120 and lower 1130 compartments. The probe 1310 extends perpendicularly from the upper compartment 1120 and has a keyed shape corresponding to the outlet receptacle 510 (FIGS. 2A–E). The upper compartment 1130 has finger grips 1410 that facilitate plug removal and insertion. The upper compartment 1120 also has a cutout 1420 that accepts the finger hold 1500. The lower compartment 1130 houses a standard AC plug 10, which inserts into a corresponding standard AC socket 1150 (FIGS. 11E–F). In this manner, a standard AC plug 10 is adapted to a locking plug 1200.

Also shown in FIGS. 11A–B, the plug 1200 has a locked position with the finger hold 1500 pushed into the upper plug compartment 1120 and prongs 1900 extended from, and generally perpendicular to, the probe 1310, one from each corner. In this locked position, with the probe 1310 inserted into an outlet receptacle 510 (FIGS. 2A–E), the prongs 1900 each extend into an access aperture 520 (FIGS. 2A–E), which locks the plug 1200 into the outlet 300 (FIGS. 2A–E). One prong 1900 has a neutral contact 1282 configured to electrically connect to a neutral outlet contact 382 (FIG. 3A). Another prong 1900 has a hot contact 1284 configured to electrically connect to a hot outlet contact 384 (FIG. 3A). A ground bar 1700 extends along the apex of the probe 1310 and is configured to electrically connect to an outlet ground sleeve 700 (FIGS. 7A–D).

As shown in FIGS. 11C–D, the plug 1200 has an unlocked position with the finger hold 1500 pulled out of the upper plug compartment 1120 and the prongs 1900 retracted into the probe 1310. In this position, the plug 1200 can be inserted or removed from an outlet 300 (FIGS. 2A–E). A gasket 1210 fits around the perimeter of the probe 1310 and against the front face of the case 1110. When the plug 1200 is inserted into an outlet 300 (FIGS. 2A–E), the gasket 1210 provides a gas-tight seal for the outlet contact 382, 384 and plug contacts 1282, 1284, reducing the explosion hazard from sparks in the presence of volatile gases and fumes.

Also shown in FIGS. 11C–D, a door 1600 covers the standard AC plug 10 contained in the lower compartment 1130. The door 1600 is retained on the case 1110 by a screw 1270 threaded through one of several adjustment holes 1610 and into a door retention hole 1308 (FIGS. 13A–D). This allows the door 1600 to accommodate various plug sizes.

As shown in FIGS. 11E–F, the door 1600 (FIGS. 11C–D) is removable for access to an AC plug 10. Guides 1160 on either side of the case 1110 allow the door 1600 (FIGS. 11C–D) to slide over the lower compartment 1130. An AC plug 10 can be inserted into and removed from a standard AC socket 1150 incorporated within the lower compartment 1130. Contact clips 1800 (FIGS. 18A–D), 2000 (FIGS. 20A–D), 2100 (FIGS. 21A–D) within the socket 1150 provide an electrical connection with the ground bar 1700 and prongs 1900.

Locking Plug Components

Figure 12:
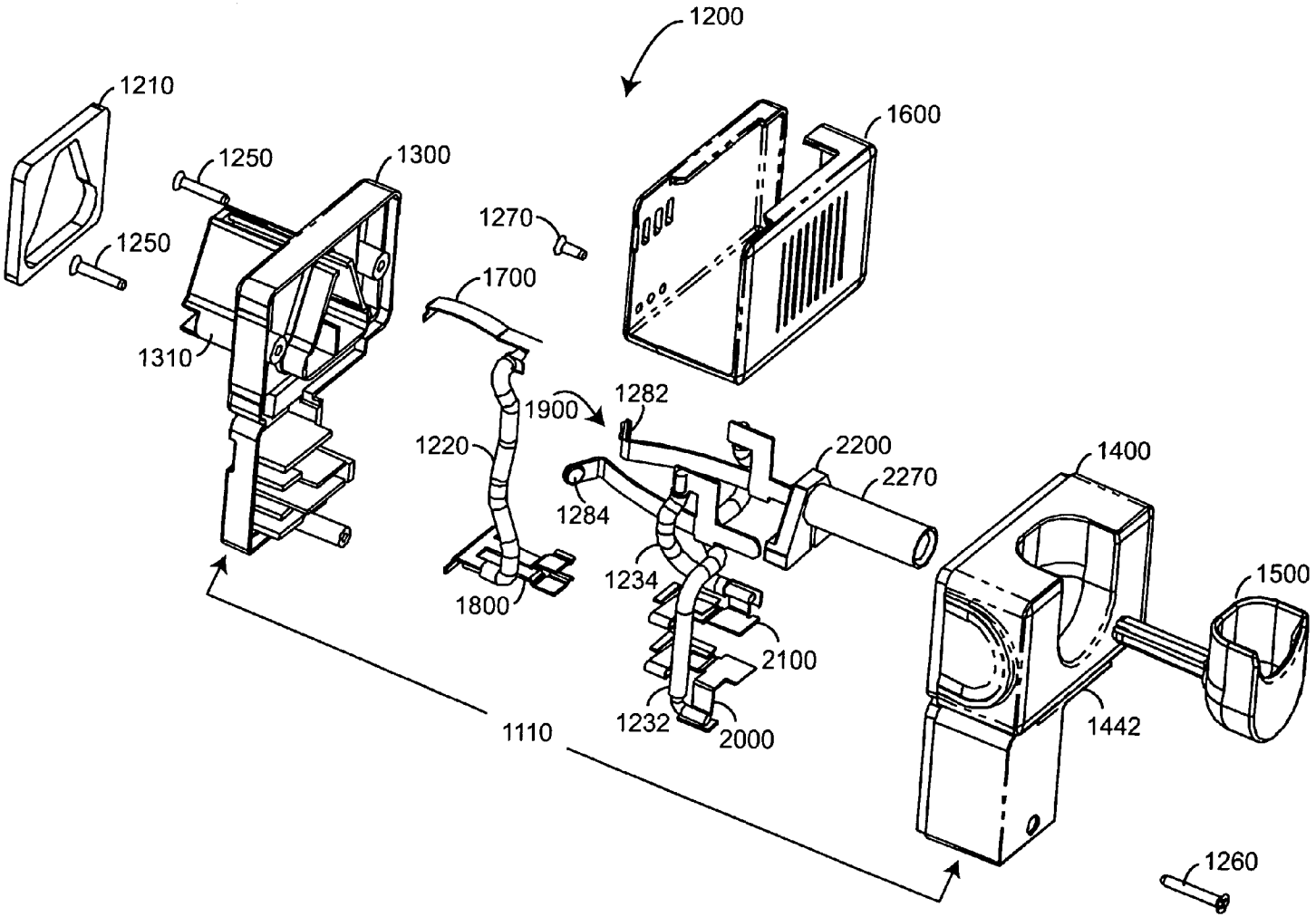
Figure 13B:
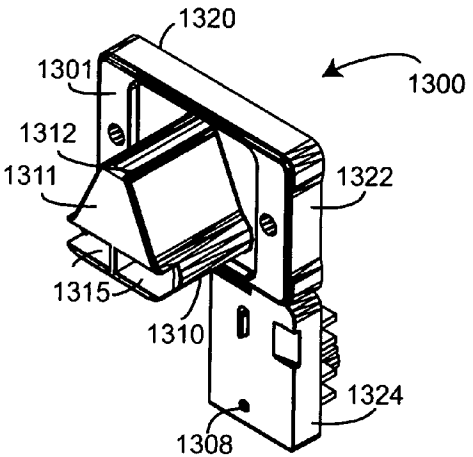
FIGS. 13A–D are top, perspective, front and side views of a plug housing front-half.
Figure 13D:
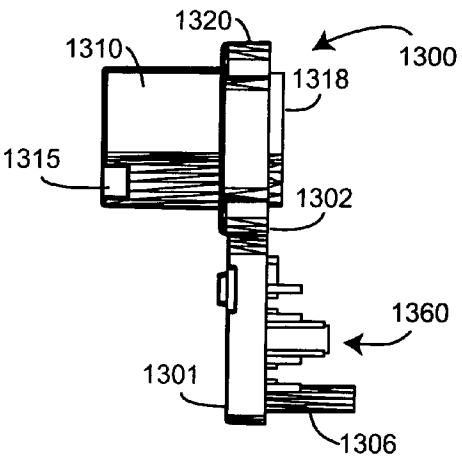
Figure 13A:
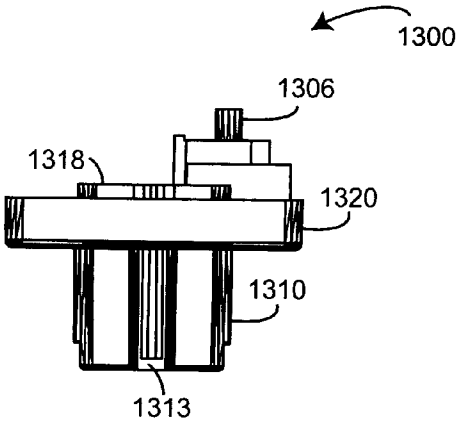
Figure 13C:
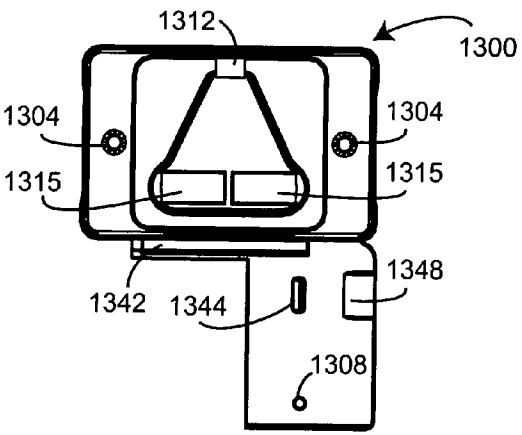
Figure 14B:
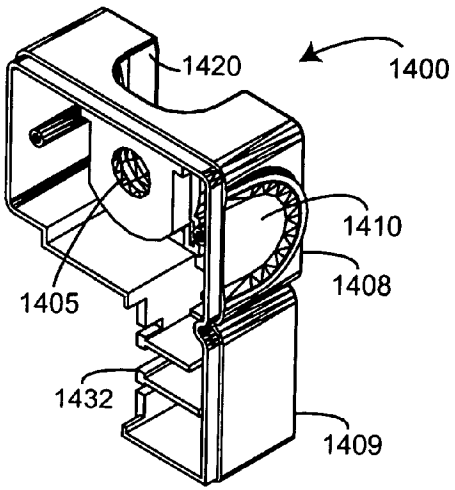
FIGS. 14A–D are top, perspective, front and side views of the plug housing back-half.
Figure 14D:
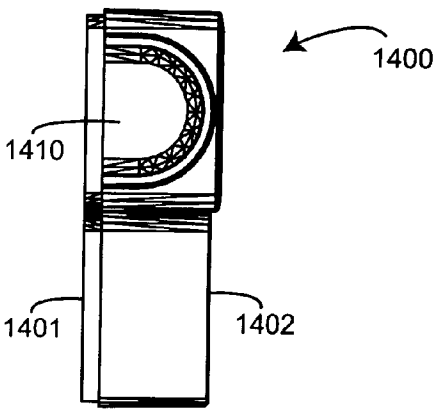
Figure 14A:
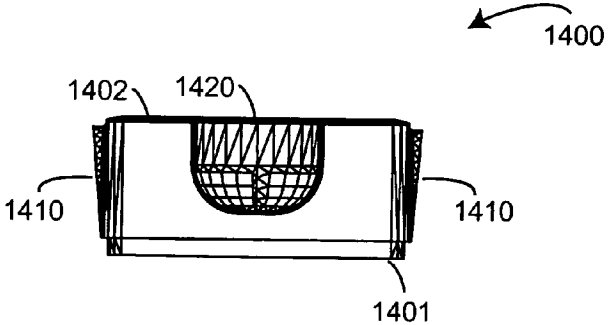
Figure 14C:
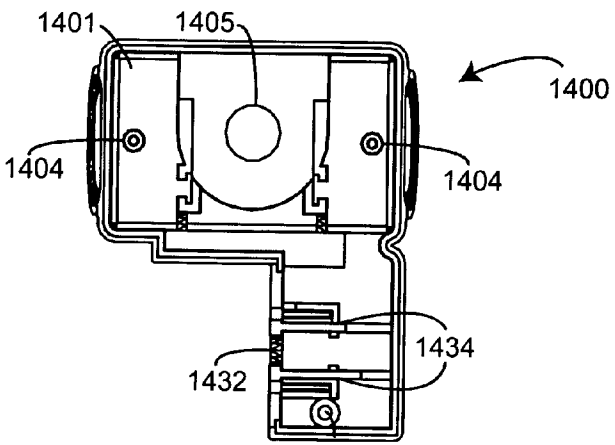
Figure 15A:
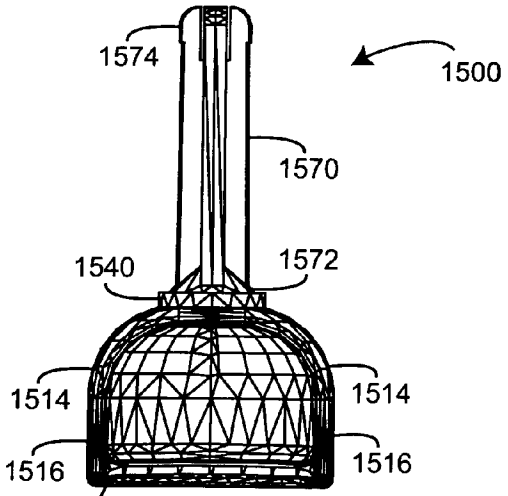
FIGS. 15A–D are top, perspective, front and side views of a finger hold.
Figure 15B:
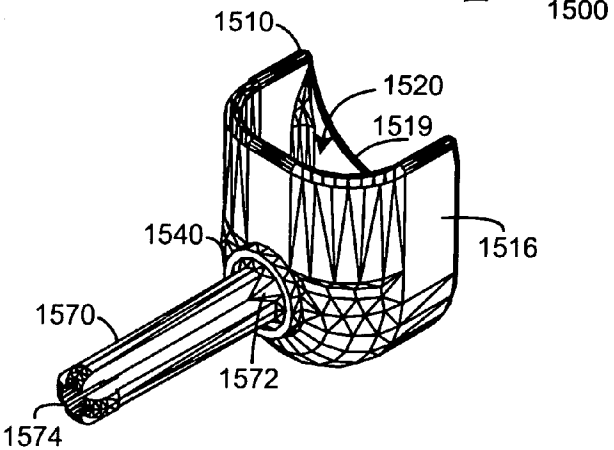
Figure 15C:
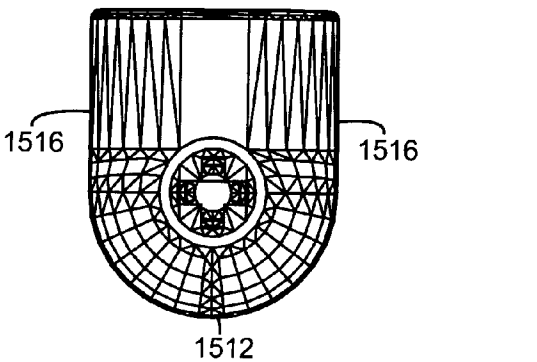
Figure 15D:
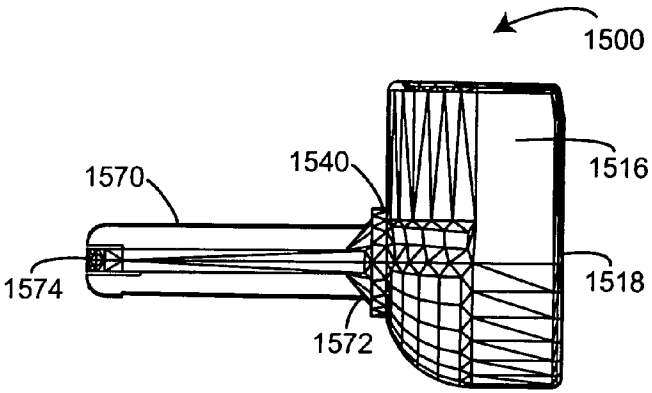
Figure 16B:
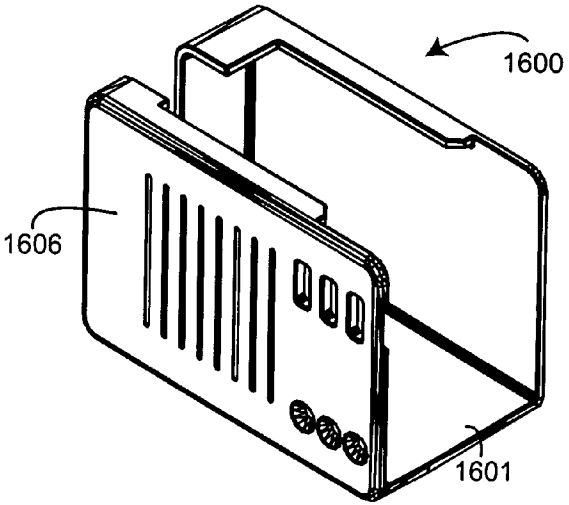
FIGS. 16A–D are top, perspective, front and side views of a plug door.
Figure 16D:
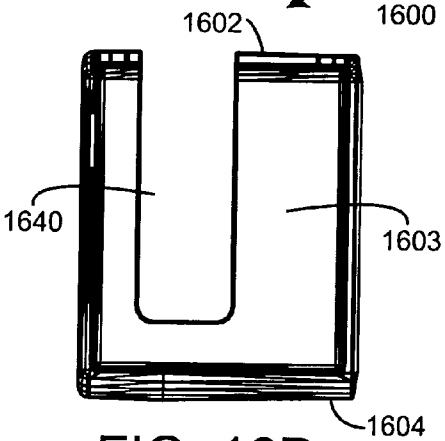
Figure 16A:
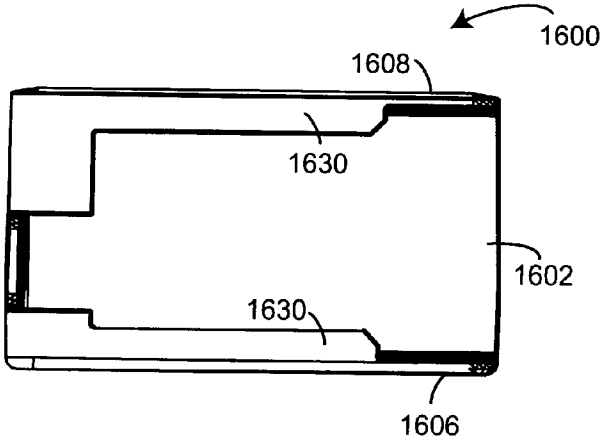
Figure 16C:
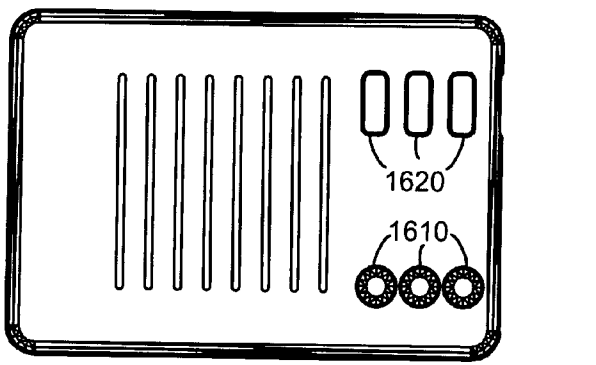
Figure 17A:
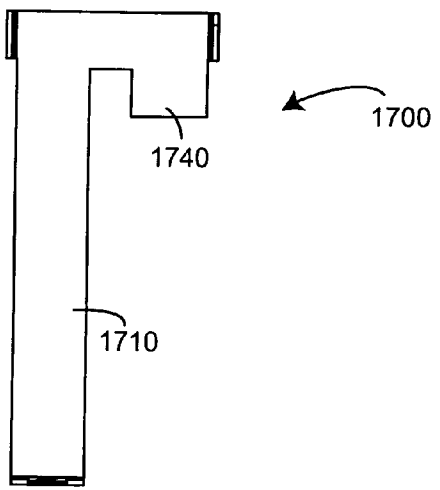
FIGS. 17A–D are top, perspective, front and side views of a ground bar.
Figure 17B:
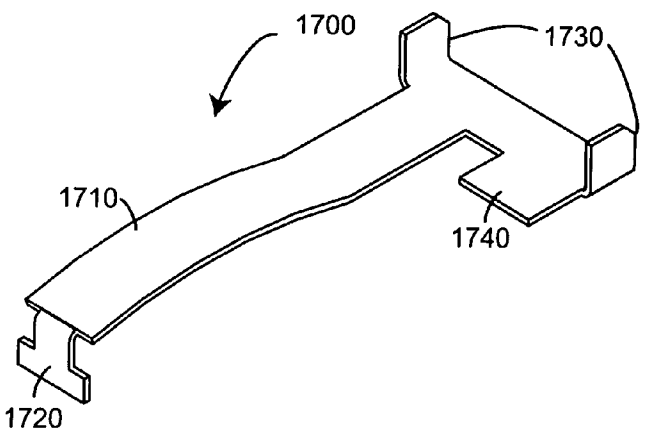
Figure 17C:
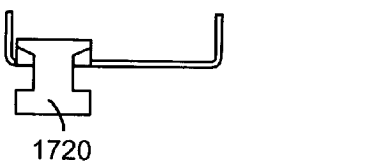
Figure 17D:
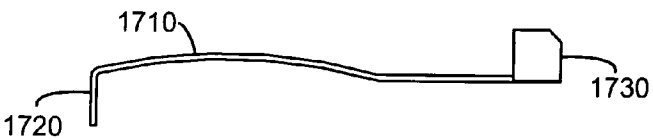
Figure 18B:
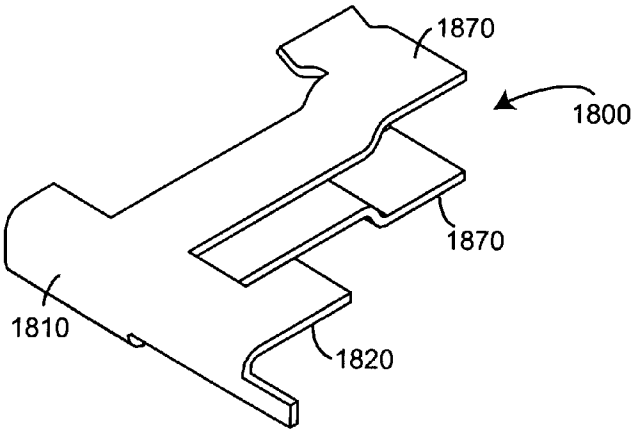
FIGS. 18A–D are top, perspective, front and side views of a ground clip.
Figure 18D:
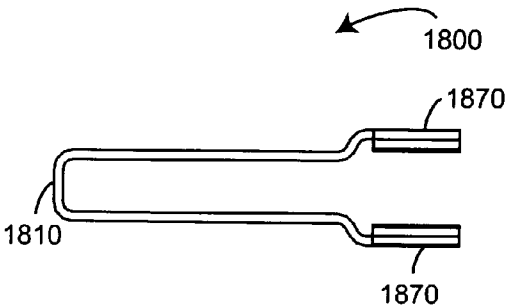
Figure 18A:
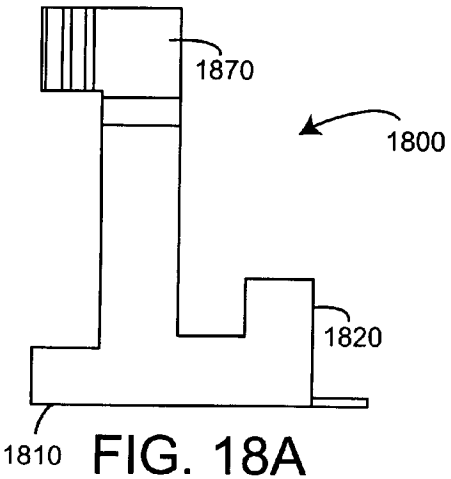
Figure 18C:
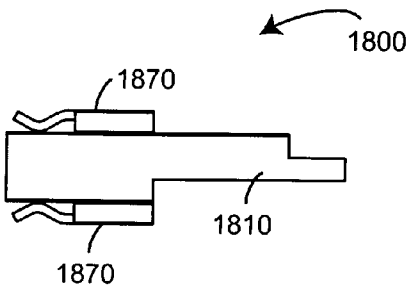

FIG. 12 illustrates the various components of a locking plug 1200 configured as an adapter for a conventional AC plug. The locking plug 1200 has plug housing front 1300, a plug housing back 1400, a finger hold 1500, a door 1600, a ground bar 1700, a ground clip 1800, prongs 1900, a neutral clip 2000, a hot clip 2100, and a slide 2200. The housing front half 1300 and back half 1400 provide a housing 1110 for the plug contacts and conductors, a probe 1310 for insertion into the corresponding outlet 300 (FIGS. 2A–E) and an adapter socket 1150 (FIG. 11F) for a standard AC plug. The housing halves 1300, 1400 are held together with top screws 1250 inserted from the front half 1300 and a bottom screw 1260 inserted from the back half 1400. A gasket 1210 fitted around the probe 1310 provides a seal between a covered outlet 300 (FIGS. 2A–E) and the locking plug 1200 when inserted. The housing halves 1300, 1400 are described in more detail with respect to FIGS. 13A–D and FIGS. 14A–D below.

As shown in FIG. 12, the finger hold 1500 has a stem 1570 that is inserted through the housing back half 1400 and into a slide post 2270. The slide 2200 is moveable within the probe 1310 so as to actuate the prongs 1900. Specifically, when the finger hold 1500 is pulled out from the housing 1110, the slide 2200 allows the prongs 1900 to retract. When the finger hold 1500 is pushed into the housing 1110, the slide 2200 forces the prongs 1900 outward, causing them to extend from the probe 1310. The finger hold 1500 is described in further detail with respect to FIGS. 15A–D, below. The slide 2200 is described in further detail with respect to FIGS. 22A–D, below.

Also shown in FIG. 12, the door 1600 slides onto the housing 1110 to enclose, retain and provide strain relief for a standard AC plug inserted into the adapter socket 1150 (FIG. 1F). The door 600 is held in place with a retaining screw 1270 threaded through one of several adjustment holes, allowing the door to accommodate various sized standard AC plugs. The door 1600 is described in further detail with respect to FIGS. 16A–D, below.

Further, FIG. 12 illustrates the ground path from an outlet 300 (FIGS. 2A–E) to a standard AC plug. A ground bar 1700 is located on the probe 1310 and contacts an outlet ground sleeve when the locking plug 1200 is inserted into a covered outlet 300 (FIGS. 2A–E). A ground jumper 1220 electrically connects the ground bar 1700 to a ground clip 1800. A standard AC plug ground pin connects with the ground clip 1800 when inserted into the adapter socket 1150 (FIG. 1F). The ground bar 1700 is described in further detail with respect to FIGS. 17A–D, below. The ground clip 1800 is described in further detail with respect to FIGS. 18A–D, below.

In addition, FIG. 12 illustrates the current carrying paths from an outlet 300 (FIGS. 2A–E) to a standard AC plug. The prongs 1900 have neutral 1282 and hot 1284 contacts. When the plug 1200 is inserted in an outlet 300 (FIGS. 2A–E) and placed in the locked position, the prongs 1900 extend so that the neutral 1282 and hot 1284 plug contacts separately connect with neutral and hot outlet contacts. A neutral jumper 1232 electrically connects the neutral contact 1282 to a neutral clip 2000. A hot jumper 1234 electrically connects the hot contact 1284 to a hot clip 2100. Standard AC plug hot and neutral blades separately connect with the neutral 2000 and hot 2100 clips when inserted into the adapter socket 1150 (FIG. 1F). The prongs 1900 are described in further detail with respect to FIGS. 19A–E, below. The neutral clip 2000 is described in further detail with respect to FIGS. 20A–D, below. The hot clip 2100 is described in further detail with respect to FIGS. 21A–D, below.

Plug Housing

FIGS. 13A–D and 14A–D illustrate the front half 1300 and back half 1400 of the plug housing 1110 (FIGS. 11A–F), respectively. FIGS. 13A–D show the housing front half 1300 has a probe 1310 and a case half 1320. The case half 1320 has a generally planar front face 1301, an open and structured back face 1302, an upper portion 1322 and a lower portion 1324.

As shown in FIGS. 13A–D, at the upper portion 1322, the probe 1310 extends normally from the housing front face 1301 to a planar front face 1311. In a particular embodiment, the access openings 520 (FIGS. 5A–E) are recessed at least about 0.6 inches from the face plate cutouts 430 (FIGS. 4A–E), as described with respect to FIGS. 5A–E, above. In a corresponding embodiment, the probe extends at least about 0.6 inches from the housing front face 1301 to the probe front face 1311. The probe 1310 is generally hollow, and has an open back face 1318 proximate the housing back face 1302 to accept the prongs 1900 (FIGS. 19A–E) and slide 2200 (FIGS. 22A–D). The front face 1311 is keyed and, in one embodiment, is generally triangular in shape with an apex, base and corners corresponding to the shape of the face plate cutouts 430 (FIGS. 4A–E) and the outlet receptacles 510 (FIGS. 5A–E), as described with respect to FIGS. 4A–E, above. The probe 1310 has a groove 1312 running its length along the apex and a slot 1313 near the probe face 1311. The slot 1313 accepts a ground bar insert 1720 (FIGS. 17A–D) to retain the ground bar 1700 (FIGS. 17A–D) within the groove 1312. Elongated openings 1315 at the probe face 1311 near its base provide for the extension and retraction of prongs 1900 from the probe 1310.

Also shown in FIGS. 13A–D, at the lower portion 1324 along the front face 1301 is a guide half 1342, a door catch 1344 and an indent 1348. Along the back face 1302 is a post 1306 and socket structure 1360. The guide half 1342, in conjunction with a corresponding guide half on the housing back half 1400 (FIGS. 14A–D) slidably retains a plug door 1600 (FIGS. 16A–D), described below. The door catch 1344 releasably engages one of several door latches 1620 (FIGS. 16A–D) for adjusting to various AC plug sizes. The indent 1348 allows a tool to remove the catch 1344 from a latch 1620 (FIGS. 16A–D). A retention hole 1308 accepts a screw to secure the door 1600 (FIGS. 16A–D). Socket structure 1360 retains the ground clip 1800 (FIGS. 18A–D), neutral clip 2000 (FIGS. 20A–D) and hot clip 2100 (FIGS. 21A–D). The post 1306 along with screw holes 1304 accept screws to secure together the housing halves 1300, 1400 (FIGS. 14A–D).

FIGS. 14A–D show the housing back half 1400 has an open and structured front face 1401, a generally planar back face 1402, an upper portion 1408 and a lower portion 1409. The upper portion 1408 has finger grips 1410 along each side, a post hole 1405, a cutout 1420 and mounting posts 1404. The finger grips 1410 facilitate insertion and removal of the plug 1200 (FIGS. 11A–E). The post hole 1405 accommodates, and slidably retains, the slide post 2270 (FIGS. 22A–D) inserted from the front face 1401 and the finger hold stem 1570 (FIGS. 15A–D) inserted from the back face 1402 into the slide post 2270 (FIGS. 22A–D). The cutout 1420 accommodates the finger hold cup 1510 (FIGS. 15A–D) when the finger hold 1500 (FIGS. 15A–D) is pushed-in and the plug 1200 (FIGS. 11A–E) is in the locked position. The mounting posts 1404 mate with the screw holes 1304, which accept screws to secure together the housing halves 1300 (FIGS. 13A–D), 1400.

Also shown in FIGS. 14A–D, the lower portion 1409 has a socket face 1432, clip structure 1434 and a screw hole 1406. The socket face 1432 forms most of the socket 1150 (FIGS. 11A–E) for insertion of a standard AC plug. The clip structure 1434 retains the ground clip 1800 (FIGS. 18A–D), neutral clip 2000 (FIGS. 20A–D) and hot clip 2100 (FIGS. 21A–D). A guide half 1442 (FIG. 12), in conjunction with a corresponding front half guide 1342 (FIGS. 13A–D), slidably retains a plug door 1600 (FIGS. 16A–D), described below. The screw hole 1406 mates with the post 1306 and accepts a screw to secure together the housing halves 1300 (FIGS. 13A–D), 1400.

Finger Hold

FIGS. 15A–D illustrate the finger hold 1500, which has a cup 1510, a collar 1540 and a stem 1570. The cup 1510 has a generally rounded bottom 1512 and back 1514 and generally flat sides 1516 and front 1518 defining a cavity 1520. The cup back 1514 has a round collar 1540 formed thereon. The cup front 1518 has a crescent-shaped lip 1519. The cavity 1520 provides a place to insert a fingertip in order to pull-out or push-in the finger hold 1500, unlocking or locking the plug 1200. The crescent-shaped lip 1519 allows fingertip access to the cavity 1520 when two plugs 1200 are inserted, as shown in FIG. 1C, above.

Also shown in FIGS. 15A–D, a cross-shaped, cross-section stem 1570 has a slightly flared base 1572 proximate the collar 1540 and a slightly flared and slotted tip 1574 distal the collar 1540. The stem 1570 extends, and is slightly tapered, from base 1572 to the tip 1574 in a direction generally normal to the front 1519. The tapered, cross-sectioned stem 1570, slotted and flared tip 1574 and flared base 1572 facilitate insertion and retention of the stem 1570 into a slide post 2270 (FIGS. 22A–D). The collar 1540 provides a stop and mating portion to the post end 2272 (FIGS. 22A–D). Attached to the slide post 2270 (FIGS. 22A–D), movement of the finger hold 1500 actuates the slide 2200 (FIGS. 22A–D) and extends or retracts the prongs 1900 (FIGS. 19A–E), locking and unlocking the plug 1200 (FIGS. 11A–F), accordingly.

Plug Door

FIGS. 16A–D illustrate a plug door 1600, which is generally box-shaped with an open top 1602 and closed bottom 1604, an open first side 1601 and a second side 1603 having a cord slot 1640, and a front face 1606 and back face 1608. The door covers and retains a standard AC plug inserted in an adapter socket 1150 (FIGS. 11A–F). The top 1602 has rails 1630 that fit over and slide along housing guides 1160 (FIGS. 1A–F). The front face 1606 has adjustment holes 1610 and latches 1620 that allow the door 1600 to accommodate different-sized standard AC plugs. The latches 1620 position the door on a catch 1344 (FIGS. 13A–D) and a screw threaded into an adjustment hole 1610 aligned with a retention hole 1308 (FIGS. 13A–D) secures the door 1600. The cord slot 1640 accommodates a standard AC power cord and functions as a strain relief.

Ground Bar

FIGS. 17A–D illustrate the ground bar 1700, which has an elongated, curved spring contact 1710, an insert 1720 at one end of the contact 1720, stops 1730 at the other end of the contact 1720 and a jumper pad 1740. The contact 1710 is shaped to fit along a groove 1312 (FIGS. 13A–D) at the probe apex. The ground bar 1700 is retained along the apex by the insert 1720 fitted into a groove slot 1313 (FIGS. 13A–D) at the probe face 1311 (FIGS. 13A–D) and the housing back 1400 (FIGS. 14A–D) fastened against the stops 1730 at the probe back face 1318 (FIGS. 13A–D). A wire end of a ground jumper 1220 (FIG. 12) is resistance welded to the pad 1740. The spring contact wipes along and maintains pressure against the outlet ground sleeve 1700 (FIGS. 17A–D) when the plug 1200 (FIGS. 11A–F) is inserted in an outlet receptacle 510 (FIGS. 2A–E). A ground path is then established from the ground sleeve 700 (FIGS. 7A–D), through the ground bar 1700 and jumper 1220 (FIG. 12), to the ground clip 1800 (FIGS. 18A–D).

Ground Clip

FIGS. 18A–D illustrate the ground clip 1800, which has a "U"-shaped insert 1810, a jumper pad 1820 and ground pin contacts 1870. The insert 1810 fits into housing socket structure 1360 (FIGS. 13A–D) that retains the ground clip 1800. One end of a ground jumper 1220 (FIG. 12) is resistance welded to the jumper pad 1820, electrically connecting the ground clip 1800 to a ground bar 1700 (FIGS. 17A–D). The ground pin contacts 1870 accept a standard AC plug ground pin inserted into the adapter socket 1150 (FIG. 11F).

Prongs

FIGS. 19A–E illustrate the prongs 1900, which include a neutral prong 1902 and a hot prong 1904. The prongs 1900 each have a jumper pad 1910, a spring bar 1920, a contact holder 1930 and a crossbar 1950. The jumper pad 1910 attaches one end of either a neutral 1232 or hot jumper 1234 (FIG. 12), which is resistance welded to the pad 1910 to provide a conduction path to neutral 2000 (FIGS. 20A–D) or hot clips 2100 (FIGS. 21A–D). The spring bar 1920 has a static curvature that maintains a prong 1900 in a retracted position within the plug 1200 (FIGS. 11A–F). A slide 2200 (FIGS. 22A–D) mounted between the prongs 1900 pushes against, and temporarily straightens, the spring bar 1920 to move the prong 1900 to an extended position. The contact holder 1930 has a hole 1932 in which a contact 1282, 1284 (FIG. 12) is swaged. The contact holder 1930 passes through a receptacle access aperture 520 (FIGS. 2A–E) when the prong 1900 is extended, connecting the plug contact 1282, 1284 (FIG. 12) with an outlet contact 382, 383 (FIG. 3A). The crossbar 1950 connects the jumper pad 1910 to the spring bar 1920 and supports the prong 1900 within the probe 1310 (FIGS. 11A–F).

Neutral Clip

FIGS. 20A–D illustrate the neutral clip 2000, which has a neutral blade contact 2010, a jumper pad 2020 and ends 2030, 2040. The blade contact 2010 accepts a standard AC plug neutral blade inserted into the adapter socket 1150 (FIG. ° F.). One end of a neutral jumper 1232 is resistance welded to the jumper pad 2020, electrically connecting the neutral clip 2000 to a neutral prong 1902 (FIGS. 19A–D). The ends 2030, 2040 insert into the housing front half 1300 (FIGS. 13A–D) and back half 1400 (FIGS. 14A–D), respectively, retaining the neutral clip 2000.

Hot Clip

Figure 19B:
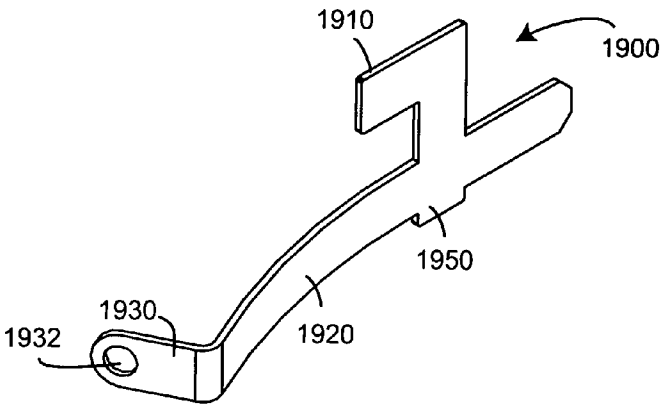
FIGS. 19A–D are top, perspective, front and side views of the neutral prong.
Figure 19D:
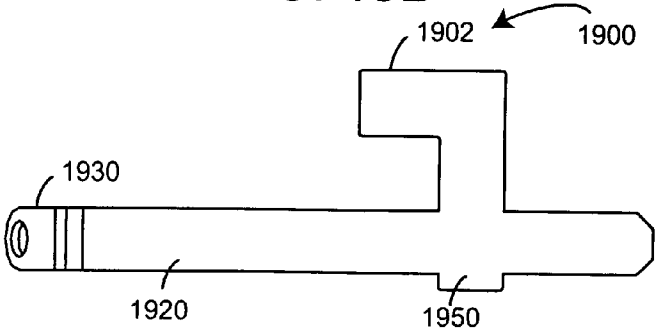
Figure 19A:
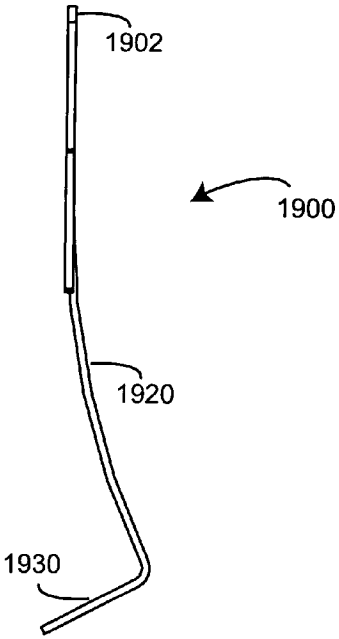
Figure 19C:
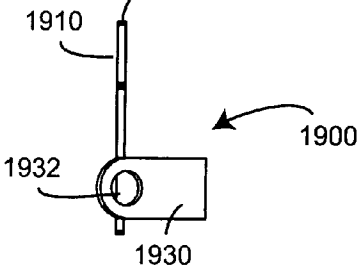
Figure 19E:
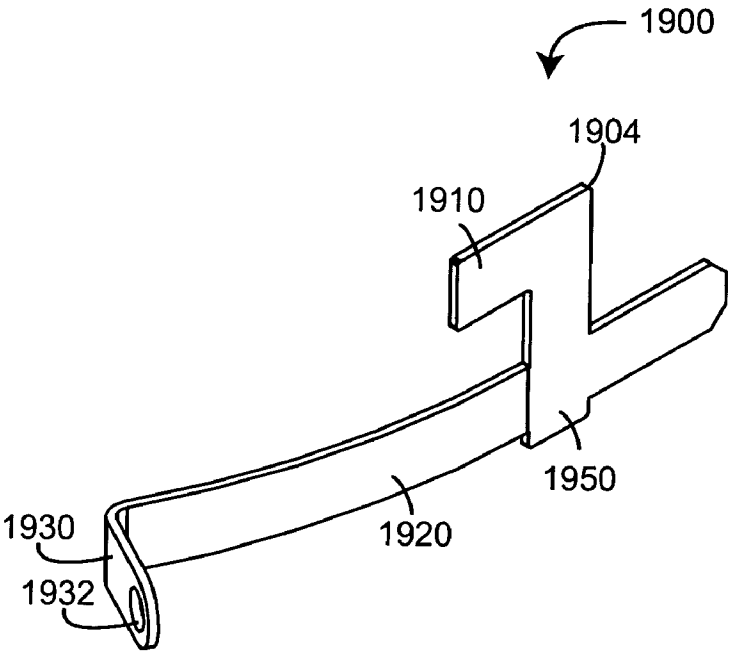
FIG. 19E is a perspective view of a hot prong.
Figure 20B:
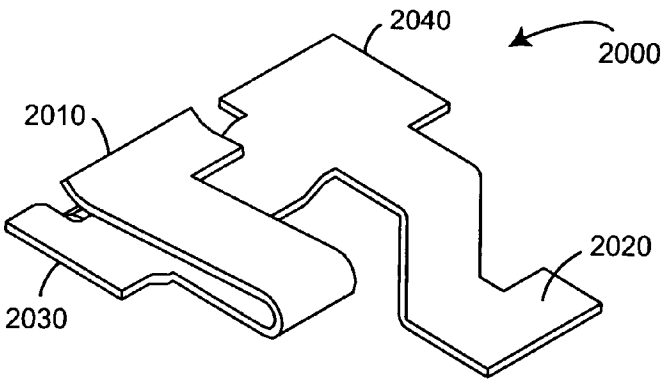
FIGS. 20A–D are top, perspective, front and side views of a neutral clip.
Figure 20D:
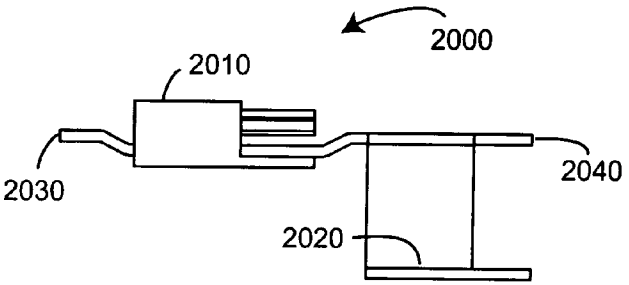
Figure 20A:
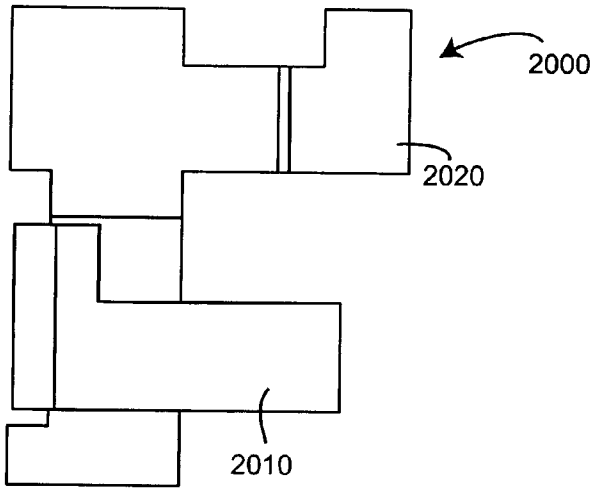
Figure 20C:
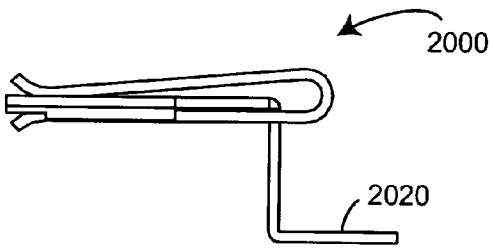
Figure 21B:
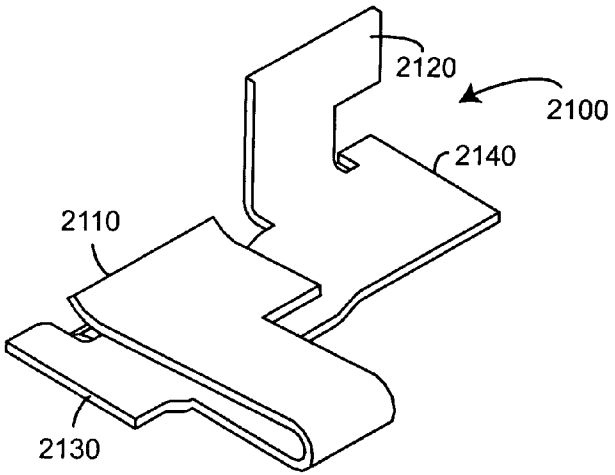
FIGS. 21A–D are top, perspective, front and side views of a hot clip.
Figure 21D:
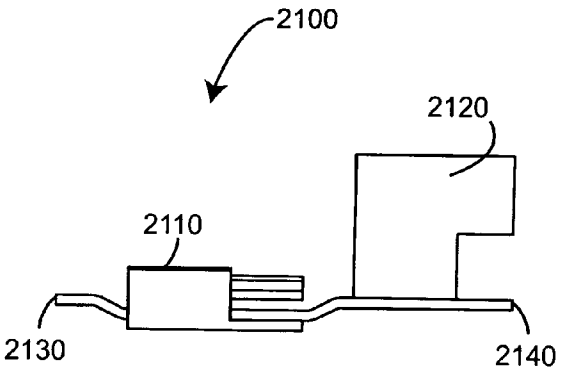
Figure 21A:
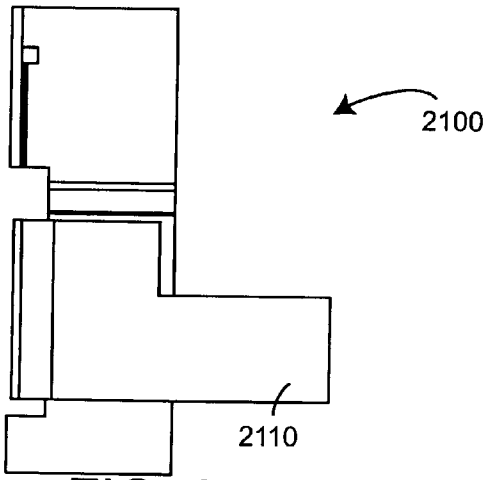
Figure 21C:
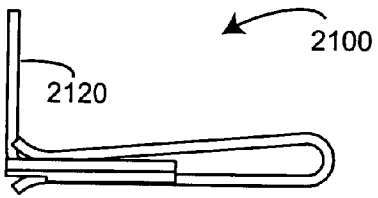
Figure 22A:
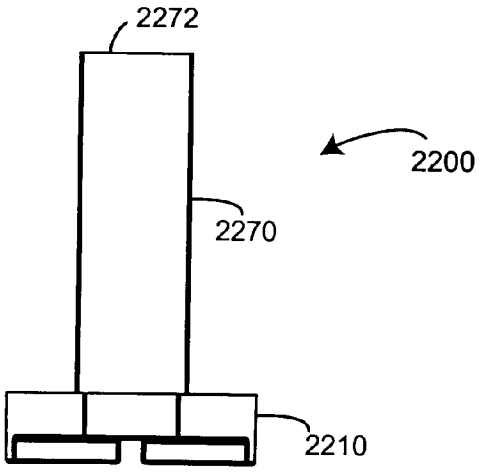
FIGS. 22A–D are top, perspective, front and side views of a slide.
Figure 22B:
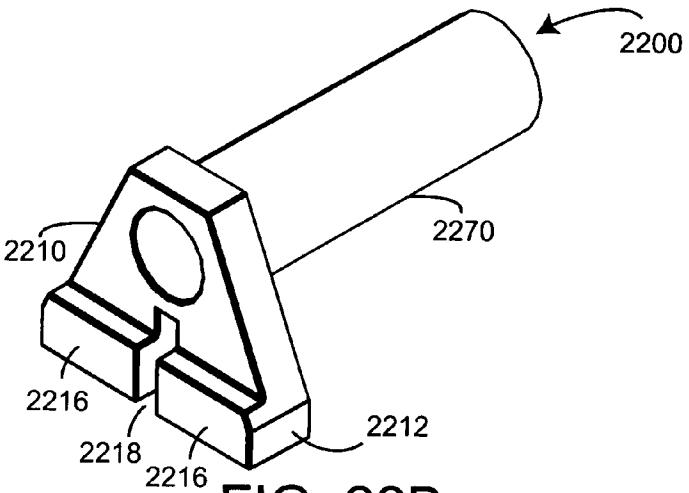
Figure 22D:
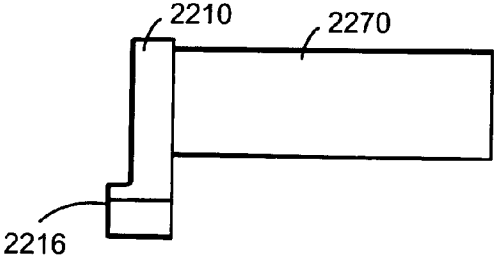
Figure 22C:
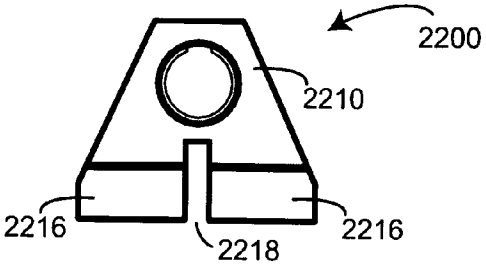

FIGS. 21A–D illustrate the hot clip 2100, which has a hot blade contact 2110, a jumper pad 2120 and ends 2130, 2140. The blade contact 2110 accepts a standard AC plug hot blade inserted into the adapter socket 1150 (FIG. 1F). One end of a hot jumper 1234 is resistance welded to the jumper pad 2120, electrically connecting the hot clip 2100 to a hot prong 1904 (FIG. 19E). The ends 2130, 2140 insert into the housing front half 1300 (FIGS. 13A–D) and back half 1400 (FIGS. 14A–D), respectively, retaining the hot clip 2100.

Slide

FIGS. 22A–D illustrate the slide 2200, which has a post 2270 with a piston 2210 mounted on one end. The post end 2272 opposite the piston 2210 is open and accommodates the finger hold stem 1570 (FIGS. 15A–D). The piston 2210 is slidably retained within the probe 1310 (FIGS. 11A–F) and has sides 2212 that press against the prong spring bars 1920 (FIGS. 19A–E). The piston 2210 has a generally triangular shape compatible with the probe 1310 (FIGS. 11A–F) cross-section. The position of the connected finger hold 1500 (FIGS. 15A–D) controls the position of the piston 2210. The piston 2210 is proximate the probe face 1311 (FIGS. 1A–F) in the plug locked position (FIGS. 11A–B) and distal the probe face 1311 (FIGS. 11A–F) and proximate the probe back face 1318 in the plug unlocked position (FIGS. 11C–D). The piston face 2214 has two elongated blocks 2216 extending along the base and a vertical slot 2218 between the blocks 2216. The blocks 2216 fit within the probe face openings 1315 (FIGS. 13A–D) in the plug locked position, forcing the prongs 1900 (FIGS. 19A–E) to extend from the probe 1310 (FIGS. 1A–F). In the plug unlocked position, the piston is distal the prong spring bars 1920 (FIGS. 19A–E), allowing the spring bars 1920 (FIGS. 19A–E) to retract the prongs 1900 into the probe 1310 (FIGS. 1A–F). The vertical slot 2218 mates with a corresponding guide within the probe 1310.

Although the locking plug was described with respect to a finger hold prong actuator, another embodiment is a plug with side-mounted push-buttons. When pressed, the buttons would squeeze the prongs together, moving the prongs to the retracted position. The buttons would be held down to insert the plug and released to lock the plug in an outlet. Further, the locking plug was described as an adapter plug, which has a socket that accepts a standard AC plug. Another embodiment would be a locking plug with a directly wired power cord.

The outlet was described in terms of duplex receptacles. One of ordinary skill in the art will recognize that the scope of a safety electrical connection system would also include a single receptacle outlet or outlets of more than two receptacles or ganged outlets.

Both the locking plug and the covered outlet were described as having jumper wires to internally connect various contacts and conductive elements. In an alternative embodiment, each jumper is replaced with a solid stamped buss. In the outlet, the solid stamped busses could be implemented with breakaway portions to electrically isolate the two receptacles and allowing the outlet to be configured as either full-hot or half-hot.

One of ordinary skill in the art will recognize that a locking plug or adapter plug can also be configured to extend parallel to the case or at a variety of other angles. Further, plugs and corresponding receptacles and covers can have a number of cross-sectional shapes other than the generally triangular shaped described above, all within the scope of a safety electrical connection system.

The safety electrical plug has been disclosed in detail in connection with various embodiments of a safety electrical connection system. These embodiments are disclosed by way of examples only and are not to limit the scope of the claims that follow. One of ordinary skill in the art will appreciate many variations and modifications.

What is claimed is:

1. An electrical plug comprising:

a plug housing having a housing face;

a generally hollow probe extending from said housing face to a probe face;

a plurality of prongs disposed within said probe, said prongs urged to an unlocked position retracted into said probe and movable to a locked position extending from said probe face; and a piston retained within said probe between said prongs, said piston slidable between a first position proximate said probe face so as to force said prongs to said locked position and a second position distal said probe face so as to allow said prongs to retract to said unlocked position.

2. An electrical plug comprising:

a plug housing;

a probe portion of said housing adapted to insert into an electrical outlet;

a plurality of prongs retained by said probe portion;

said prongs moveable between a first position retracted within said probe portion and a second position extending from said probe portion, said prongs adapted to connect to an electrical power source at said outlet in said second position;

a plurality of conductors within said plug housing adapted to carry current between said prongs and an electrical load;

an adapter socket disposed in said plug housing;

a plurality of clips retained by said adapter socket configured to accept a standard AC electrical plug, said clips electrically connected to said prongs; and a door adapted to cover and retain said standard AC electrical plug.

3. The electrical plug according to claim 2 further comprising a ground bar retained along said probe portion adapted to establish a ground path to said electrical outlet.

4. An electrical plug comprising:

a housing;

a probe extending from said housing;

a pair of prongs disposed within said probe;

a plurality of curved spring bar portions of said prongs configured to urge said prongs to retract within said probe; and a piston slidably retained within said probe, said piston movable between a first position pressing against said spring bar portions so as to force said prongs to extend from said probe and a second position allowing said spring bar portions to retract said prongs within said probe.

5. The electrical plug according to claim 4 further comprising:

a probe face of said probe having corners;

a pair of elongated openings defined by said probe face proximate said corners, said prongs configured to extend generally perpendicular to said probe from said openings.

6. The electrical plug according to claim 5 further comprising:

a finger hold adapted to a finger tip; and a post connecting said finger hold to said piston allowing said finger hold to actuate said piston so as to extend and retract said prongs.

* * * * *